US007884788B2

(12) United States Patent
Miyata et al.

(10) Patent No.: US 7,884,788 B2
(45) Date of Patent: Feb. 8, 2011

(54) LIQUID CRYSTAL DISPLAY DEVICE AND ELECTRONIC APPARATUS

(75) Inventors: Kazuhiko Miyata, Habikino (JP); Jun Koyama, Sagamihara (JP); Hiroyuki Miyake, Atsugi (JP); Kei Takahashi, Atsugi (JP)

(73) Assignees: Semiconductor Energy Laboratory Co., Ltd, Atsugi-shi, Kanagawa-ken (JP); Sharp Kabushiki Kaisha, Osaka-shi (JP)

( * ) Notice: Subject to any disclaimer, the term of this patent is extended or adjusted under 35 U.S.C. 154(b) by 1271 days.

(21) Appl. No.: 10/902,793

(22) Filed: Aug. 2, 2004

(65) Prior Publication Data

US 2005/0030270 A1 Feb. 10, 2005

(30) Foreign Application Priority Data

Aug. 4, 2003 (JP) ..... 2003-285984

(51) Int. Cl.
*G09G 3/36* (2006.01)

(52) U.S. Cl. ..... 345/87; 349/158

(58) Field of Classification Search ..... 345/87, 345/100; 349/158; 341/144, 138, 139, 163; 340/347
See application file for complete search history.

(56) References Cited

U.S. PATENT DOCUMENTS 4,736,188 A * 4/1988 Jackson ..... 341/163
4,818,996 A * 4/1989 Kimura ..... 341/144
5,643,804 A 7/1997 Arai et al.
5,650,834 A 7/1997 Nakagawa et al.
5,877,533 A 3/1999 Arai et al.
6,154,161 A * 11/2000 Leme et al. ..... 341/143
6,380,876 B1 4/2002 Nagao
6,410,960 B1 6/2002 Arai et al.
6,549,196 B1 4/2003 Taguchi et al.
7,253,869 B1 * 8/2007 Russell et al. ..... 349/158
2003/0001832 A1 1/2003 Yamazaki et al.
2003/0013499 A1 1/2003 Aotake et al.

FOREIGN PATENT DOCUMENTS

EP 1 276 309 1/2003
JP 2000-138586 5/2000
JP 2000-165243 6/2000
JP 2000-244321 9/2000
JP 2002-324845 11/2002

OTHER PUBLICATIONS

Search Report (European Patent Application No. 04018412.9) dated Jan. 23, 2008.

* cited by examiner

*Primary Examiner*—Quan-Zhen Wang
*Assistant Examiner*—Yuk Chow
(74) *Attorney, Agent, or Firm*—Eric J. Robinson; Robinson Intellectual Property Law Office, P.C.

(57) ABSTRACT

A liquid crystal display device provided with an audio signal processing function, which includes an audio signal processing circuit with a large S/N ratio and a small glitch is provided. The display device of the invention includes a resistor string D/A converter circuit whose dynamic range can be increased by using a common power supply for a D/A converter circuit and a signal line driver circuit. Accordingly, a glitch generated in the D/A converter circuit can be reduced relatively to an audio signal and an S/N ratio of the D/A converted signal can thus be increased.

72 Claims, 22 Drawing Sheets

CD SERIAL DATA OUTPUT

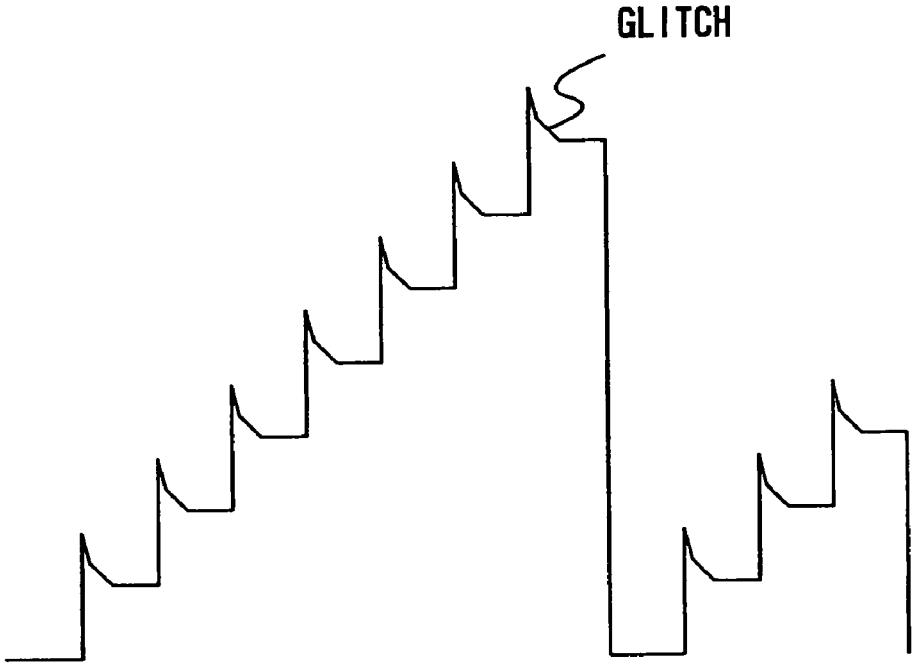
FIG. 6A OUTPUT OF D/A CONVERTER
PRIOR ART
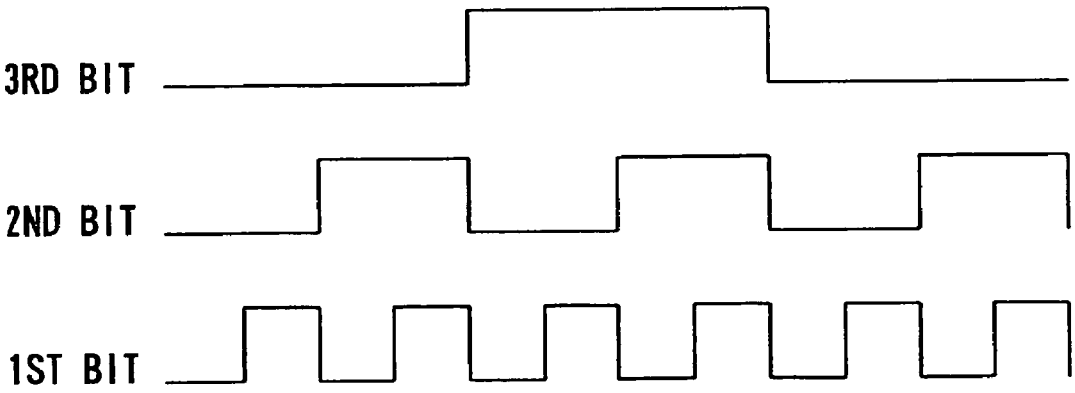
FIG. 6B DIGITAL INPUT
PRIOR ART

LIQUID CRYSTAL DISPLAY DEVICE AND ELECTRONIC APPARATUS

BACKGROUND OF THE INVENTION

1. Field of the Invention

The present invention relates to liquid crystal display device, and more particularly to a liquid crystal display device having an audio signal processing circuit formed of thin film semiconductor elements. In addition, the invention relates to an electronic apparatus using the liquid crystal display device having an audio signal processing circuit.

2. Description of the Related Art

In recent years, with the advancement of telecommunication technologies, mobile phones have been in widespread use. In future, transmission of moving images and a larger volume of information are expected. On the other hand, through reduction in weight of personal computers, those adapted for mobile communication have been produced. Information terminals called PDAs originated in electronic databooks have also been produced in large quantities and widely used. In addition, with the development of display devices, the majority of portable information devices are equipped with flat panel displays.

Among active matrix display devices, those adopting low-temperature polysilicon thin film transistors (thin film transistor is hereinafter referred to as TFT) are commercialized in recent years. By using the low-temperature polysilicon TFTs, not only pixels but also a signal line driver circuit can be integrated around the pixel portion, which contributes to downsizing or higher resolution of a display device. Therefore, it is further expected to be in wider use in future.

Meanwhile, as for portable information terminals, not only a visual display function but also other output functions such as an audio output function in particular are required. In displaying images, addition of an audio output to a visual output will bring about more satisfaction for a viewer. Thus, it is preferable that a display device has an audio output function.

Audio signals for an audio output can be classified into analog audio signals and digital audio signals. Among the analog audio signals, there are the one for directly obtaining a sound from a microphone and the like, and the one for obtaining a sound from an audio device of an analog output type. On the other hand, the digital audio signal is a signal for obtaining a sound from a digital audio device such as CD, MD and DVD players.

FIG. 2 is a block diagram showing a conversion of a digital audio signal into an analog audio signal. Most of CD players and the like are provided with an optical output which inputs an optical signal to an optical sensor 201 through an optical fiber. The optical sensor 201 converts the optical signal into an electric signal. This electric signal is specified by EIAJ (Electronic Industries Association of Japan) standard CP-1201 and the like. Then, the signal is decoded by a decoder 202 into serial digital audio data as shown in FIG. 3. The decoded signal is classified into three types: a base clock (BCL) of 1.411 MHz, an LR clock (LRCL) of 44.1 KHz and digital audio signal data (DATA). The digital audio signal data is sequentially transferred from the MSB (Most Significant Bit). The serial digital audio data is converted into parallel digital audio data by a serial-to-parallel converter circuit 203. Then, it is input to a resistor string D/A converter circuit 204 to be converted into an analog audio signal.

FIG. 5 is a conventional configuration of an audio signal processing circuit, which shows between a D/A converter circuit and a speaker connecting portion. The audio signal processing circuit includes a D/A converter circuit 501, an amplifier circuit 506, a speaker connecting portion 508, a power supply 502 for the D/A converter circuit 501, a switch 505 and an analog audio signal input terminal 507.

Operation of the circuit is described now. A parallel digital audio signal is converted into an analog audio signal in the D/A converter circuit 501 and then input to the switch 505. Meanwhile, an analog audio signal is input to the switch 505 from the analog audio signal input terminal 507. The switch 505 selects either of the output of the D/A converter circuit 501 or the analog input signal, and input it to the amplifier circuit 506. The amplifier circuit 506 amplifies the signal and output it to the speaker connecting portion 508.

A gain of the circuit is assumed to be as follows. Each output signal of the analog audio signal input terminal 507 and the D/A converter circuit 501 is at a level of 283 mVpp and 100 mVrms, and amplified 35.5 times as large in the amplifier circuit 506. That is, a signal at a level of 10 Vpp and 3.54 Vrms can be obtained at the speaker connecting portion 508.

As for the conventional audio signal processing circuit, there is the one including a D/A converter circuit with a power supply voltage of 3 V or 5 V and employing a resistor string as shown in FIG. 4. That is, a resistor string is constructed by connecting multiple resistors in series and a switch is disposed at each connecting node of the resistors, whereby the switch is turned ON/OFF to obtain a desired voltage (see Patent Document 1, for example).

[Patent Document 1] Japanese Patent Laid-Open No. 2000-138586

Operation of the circuit is described now with reference to FIG. 4. The description is given here using 3-bit signal data for simplicity, however, the actual D/A converter circuit for audio signals processes signal data of 10 bits or more in general. First, a high potential power supply is connected to a terminal VH. A low potential power supply is connected to a terminal VL. Between the terminals VH and VL, seven resistors 401 to 407 are connected in series. The resistors 401 to 407 are assumed to have the same resistance value. Assuming that the VL is at 2.3 V and VH is at 3.9 V, both ends of each resistor have a potential of 0.2 V. Then, switches 408 to 415 are connected at connecting nodes of the resistors 401 to 407. Furthermore, each pair of the switches 408 to 415, which are connected to on of the resistors 401 to 409 in common, is connected to switches 416 to 419 respectively. Then, the switches 416 and 417 are collectively connected to a switch 420, and similarly, the switches 418 and 419 are collectively connected to a switch 421.

Selection of the switches is controlled by a digital signal. That is, data of the LSB (Least Significant Bit) controls the switches 408 to 415, and then selects either of the switches 416, 417, 418 and 419. In addition, data of the second bit controls the switches 416 to 419, and selects either of the switches 420 and 421. In addition, data of the MSB (Most Significant Bit) controls either of the switches 420 and 421. In this manner, an output terminal 422 is connected to one of the connecting nodes of the resistors 410 to 407. For example, when the data of the LSB is 0, the switches 409, 411, 413 and 415 are turned ON while the switches 408, 410, 412 and 414 are turned ON when the data is 1. Similarly, when the data of the second bit is 0, the switches 417 and 419 are turned ON while the switches 416 and 418 are turned ON when the data is 1. When the data of the MSB is 0, the switch 421 is turned ON while the switch 420 is turned ON when the data is 1.

In the above case, when the digital audio data is 111, the switches 408, 416 and 420 are turned ON, and a voltage 3.9 V of the VH is output to the output terminal 422. Meanwhile when the data is 101, the switches 410, 417 and 420 are turned ON, and a voltage 3.5 V is output to the output terminal 422 through a buffer circuit 423. In this manner, a digital signal can be converted into an analog voltage.

SUMMARY OF THE INVENTION

According to the aforementioned resistor string D/A converter circuit, voltage is changed over by the switches. Therefore, signals are drawn to the high potential side or the low potential side in ON/OFF of the switches due to a capacitance of switching transistors, namely a gate capacitance in general, which causes a glitch as shown in FIG. 6. Such a glitch will bring about noise on the output sound. Therefore, quality of audio signals is degraded. For example, when an analog audio signal is at a level of 100 mVrms and a digital audio signal after the D/A conversion is at a level of 100 Vrms as described above and when a glitch of 10 mV is generated, noise of 1/28 is generated relatively to the output signal level 283 mVpp of the D/A converter, which degrades the S/N ratio.

Such degradation of the S/N ratio leads to an output with a quite squawky sound from a speaker, which gives an uncomfortable feeling to a listener.

In view of the foregoing, according to the invention, a power supply voltage for a D/A converter circuit is used in common for a display device, whereby the output voltage of the D/A converter circuit is increased and an influence of a glitch is relatively reduced. In addition, a gain of an audio signal processing circuit is changed according to an analog signal input or a digital signal output.

Configuration of the invention is described below. A liquid crystal display device according to the invention includes at least one pixel, one source signal line and one gate signal line on an insulating surface. The liquid crystal display device further includes a D/A converter circuit for converting a digital audio signal which is input externally into an analog audio signal, a signal line driver circuit for driving the gate signal line or the source signal line, and a power supply circuit for supplying the same voltage to the signal line driver circuit and the D/A converter circuit.

According to another configuration of the invention, a liquid crystal display device includes at least one pixel, one source signal line and one gate signal line on an insulating surface. The liquid crystal display device further includes a D/A converter circuit for converting a digital audio signal which is input externally into an analog audio signal, a signal line driver circuit for driving the gate signal line or the source signal line, a power supply circuit for supplying the same voltage to the signal line driver circuit and the D/A converter circuit, and an amplifier circuit for amplifying an output signal of the D/A converter circuit.

According to another configuration of the invention, a liquid crystal display device includes at least one pixel, one source signal line and one gate signal line on an insulating surface. The liquid crystal display device further includes a D/A converter circuit for converting a digital audio signal which is input externally into an analog audio signal, a signal line driver circuit for driving the gate signal line or the source signal line, a power supply circuit for supplying the same voltage to the signal line driver circuit and the D/A converter circuit, and an attenuator circuit for attenuating an output signal of the D/A converter circuit.

According to another configuration of the invention, a liquid crystal display device includes at least one pixel, one source signal line and one gate signal line on an insulating surface. The liquid crystal display device further includes a D/A converter circuit for converting a digital audio signal which is input externally into an analog audio signal, a signal line driver circuit for driving the gate signal line or the source signal line, a power supply circuit for supplying the same voltage to the signal line driver circuit and the D/A converter circuit, and a switch for selecting a signal from multiple different analog audio signals including the analog audio signal which has been converted in the D/A converter circuit.

According to another configuration of the invention, a liquid crystal display device includes at least one pixel, one source signal line and one gate signal line on an insulating surface. The liquid crystal display device further includes a D/A converter circuit for converting a digital audio signal which is input externally into an analog audio signal, a signal line driver circuit for driving the gate signal line or the source signal line, a power supply circuit for supplying the same voltage to the signal line driver circuit and the D/A converter circuit, a switch for selecting a signal from multiple different analog audio signals including the analog audio signal which has been converted in the D/A converter circuit and an analog audio signal which is input externally, and an amplifier circuit for amplifying an output signal of the switch.

According to another configuration of the invention, a liquid crystal display device includes at least one pixel, one source signal line and one gate signal line on an insulating surface. The liquid crystal display device further includes a D/A converter circuit for converting a digital audio signal which is input externally into an analog audio signal, a signal line driver circuit for driving the gate signal line or the source signal line, a power supply circuit for supplying the same voltage to the signal line driver circuit and the D/A converter circuit, an attenuator circuit for attenuating an output signal of the D/A converter circuit, and a switch for selecting either of an analog audio signal which is input externally or an output signal from the attenuator circuit.

According to another configuration of the invention, a liquid crystal display device includes at least one pixel, one source signal line and one gate signal line on an insulating surface. The liquid crystal display device further includes a D/A converter circuit for converting a digital audio signal which is input externally into an analog audio signal, a signal line driver circuit for driving the gate signal line or the source signal line, a power supply circuit for supplying the same voltage to the signal line driver circuit and the D/A converter circuit, an amplifier circuit for amplifying an analog audio signal which is input externally, and a switch for selecting either of an output signal of the amplifier circuit or an output signal of the D/A converter circuit.

According to another configuration of the invention, a liquid crystal display device includes at least one pixel, one source signal line and one gate signal line on an insulating surface. The liquid crystal display device further includes a D/A converter circuit for converting a digital audio signal which is input externally into an analog audio signal, a signal line driver circuit for driving the gate signal line or the source signal line, a power supply circuit for supplying the same voltage to the signal line driver circuit and the D/A converter circuit, an attenuator circuit for attenuating an output signal of the D/A converter circuit, an amplifier circuit for amplifying an analog audio signal which is input externally, and a switch for selecting either of an output signal of the attenuator circuit or an output signal of the amplifier circuit.

According to another configuration of the invention, a liquid crystal display device includes at least one pixel, one source signal line and one gate signal line on an insulating surface. The liquid crystal display device further includes a D/A converter circuit for converting a digital audio signal which is input externally into an analog audio signal, a signal line driver circuit for driving the gate signal line or the source signal line, a power supply circuit for supplying the same voltage to the signal line driver circuit and the D/A converter circuit, an attenuator circuit for attenuating an output signal of the D/A converter circuit, a switch for selecting either of an analog audio signal which is input externally or an output signal of the attenuator circuit, and an amplifier circuit for amplifying an output signal of the switch.

According to another configuration of the invention, a liquid crystal display device includes at least one pixel, one source signal line and one gate signal line on an insulating surface. The liquid crystal display device further includes a D/A converter circuit for converting a digital audio signal which is input externally into an analog audio signal, a signal line driver circuit for driving the gate signal line or the source signal line, a power supply circuit for supplying the same voltage to the signal line driver circuit and the D/A converter circuit, a first amplifier circuit for amplifying an analog audio signal which is input externally, a switch for selecting either of an output signal of the first amplifier circuit or an output signal of the D/A converter circuit, and a second amplifier circuit for amplifying an output signal of the switch.

According to another configuration of the invention, a liquid crystal display device includes at least one pixel, one source signal line and one gate signal line on an insulating surface. The liquid crystal display device further includes a D/A converter circuit for converting a digital audio signal which is input externally into an analog audio signal, a signal line driver circuit for driving the gate signal line or the source signal line, a power supply circuit for supplying the same voltage to the signal line driver circuit and the D/A converter circuit, an attenuator circuit for attenuating an output signal of the D/A converter circuit, a first amplifier circuit for amplifying an analog audio signal which is input externally, a switch for selecting either of an output signal of the first amplifier circuit or an output signal of the attenuator circuit, and a second amplifier circuit for amplifying an output signal of the switch.

According to another configuration of the invention, a liquid crystal display device includes at least one pixel, one source signal line and one gate signal line on an insulating surface. The liquid crystal display device further includes a D/A converter circuit for converting a digital audio signal which is input externally into an analog audio signal, a signal line driver circuit for driving the gate signal line or the source signal line, a power supply circuit for supplying the same voltage to the signal line driver circuit and the D/A converter circuit, a switch for selecting either of an analog audio signal which is input externally or an output signal of the D/A converter circuit, and an amplifier circuit for amplifying an output signal of the switch, wherein the gain of the amplifier circuit is changed according to ON/OFF of the switch.

According to another configuration of the invention, a liquid crystal display device includes at least one pixel, one source signal line and one gate signal line on an insulating surface. The liquid crystal display device further includes a D/A converter circuit for converting a digital audio signal which is input externally into an analog audio signal, a signal line driver circuit for driving the gate signal line or the source signal line, a power supply circuit for supplying the same voltage to the signal line driver circuit and the D/A converter circuit, an attenuator circuit for attenuating an output signal of the D/A converter circuit, a switch for selecting either of an analog audio signal which is input externally or an output signal of the attenuator circuit, and an amplifier circuit for amplifying an output signal of the switch, wherein the gain of the amplifier circuit is changed according to ON/OFF of the switch.

According to another configuration of the invention, a liquid crystal display device includes at least one pixel, one source signal line and one gate signal line on an insulating surface. The liquid crystal display device further includes a D/A converter circuit for converting a digital audio signal which is input externally into an analog audio signal, a signal line driver circuit for driving the gate signal line or the source signal line, a power supply circuit for supplying the same voltage to the signal line driver circuit and the D/A converter circuit, a first amplifier circuit for amplifying an analog audio signal which is input externally, a switch for selecting either of an output signal of the first amplifier circuit or an output signal of the D/A converter circuit, and a second amplifier circuit for amplifying an output signal of the switch, wherein the gain of the second amplifier circuit is changed according to ON/OFF of the switch.

According to another configuration of the invention, a liquid crystal display device includes at least one pixel, one source signal line and one gate signal line on an insulating surface. The liquid crystal display device further includes a D/A converter circuit for converting a digital audio signal which is input externally into an analog audio signal, a signal line driver circuit for driving the gate signal line or the source signal line, a power supply circuit for supplying the same voltage to the signal line driver circuit and the D/A converter circuit, a first amplifier circuit for amplifying an analog audio signal which is input externally, an attenuator circuit for attenuating an output signal of the D/A converter circuit, a switch for selecting either of an output signal of the first amplifier circuit or an output signal of the attenuator circuit, and a second amplifier circuit for amplifying an output signal of the switch, wherein the gain of the second amplifier circuit is changed according to ON/OFF of the switch.

According to another configuration of the invention, a liquid crystal display device includes at least one pixel, one source signal line and one gate signal line on an insulating surface. The liquid crystal display device further includes a D/A converter circuit for converting a digital audio signal which is input externally into an analog audio signal, a signal line driver circuit for driving the gate signal line or the source signal line, a power supply circuit for supplying the same voltage to the signal line driver circuit and the D/A converter circuit, a switch circuit for switching a connection by selecting one of at least two analog audio signals including an analog audio signal which is output from the D/A converter circuit, and at least one correction circuit for correcting levels of the two analog audio signals at least.

In a liquid crystal display device having the above configuration, the amplifier circuit is an operational amplifier and the gain is changed by switching a feedback register.

In a liquid crystal display device having the above configuration, the second amplifier circuit is an operational amplifier and the gain is changed by switching a feedback register.

In a liquid crystal display device having the above configuration, the signal line driver circuit and the D/A converter circuit are integrated on the insulating substrate.

In a liquid crystal display device having the above configuration, the signal line driver circuit and the D/A converter circuit are formed of TFTs.

In a liquid crystal display device having the above configuration, the D/A converter circuit is of a resistor string type, and the resistor string includes resistors each formed of a thin film semiconductor.

In a liquid crystal display device having the above configuration, the thin film semiconductor forms a capacitance with a conductive layer which is formed on the upper or lower side of the thin film semiconductor.

In a liquid crystal display device having the above configuration, the D/A converter circuit is of a resistor string type and the resistor string includes resistors each formed of a metal thin film.

In a liquid crystal display device having the above configuration, the metal film forms a capacitance with a conductive layer which is formed on the upper or lower side of the metal film.

The invention provides an electronic apparatus which includes a liquid crystal display device having any one of the above configurations.

Accordingly, a signal with a large S/N ratio and a small glitch can be obtained even when converting a digital signal in the D/A converter circuit. Thus, sound quality can be enhanced and high-quality audio data can be provided.

According to the conventional audio signal processing circuit using a resistor string D/A converter, the S/N ratio is degraded due to a glitch at ON/OFF of a transistor.

According to the invention, a power supply voltage for a resistor string D/A converter circuit is used in common for a signal line driver circuit in order to increase an amplitude of an output signal. Therefore, the S/N ratio can be improved. In addition, the gain of an amplifier circuit which is disposed on the rear stage of the D/A converter circuit is switched according to an analog signal input or a digital signal input, whereby the gain can be controlled. In this manner, favorable amplitude can be obtained in either case. According to the invention, sound quality can be improved in a display device having an audio output function.

BRIEF DESCRIPTION OF THE DRAWINGS

FIGS. 6A and 6B illustrate diagrams showing an output signal of a conventional D/A converter circuit.

DETAILED DESCRIPTION OF THE INVENTION

Embodiment modes of the invention will be hereinafter described with reference to the accompanying drawings.

Embodiment Mode 1

Figure 1:
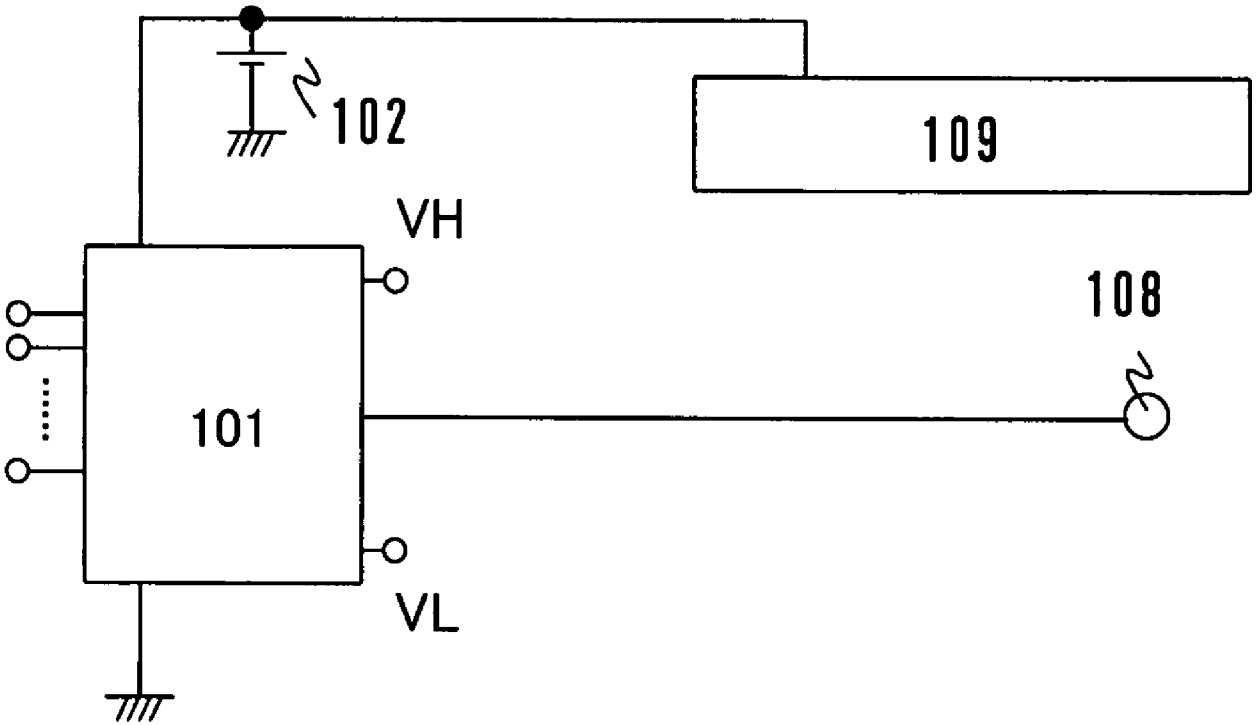
FIG. 1 illustrates an embodiment mode of an audio signal processing circuit of the liquid crystal display device of the invention.
Figure 2:
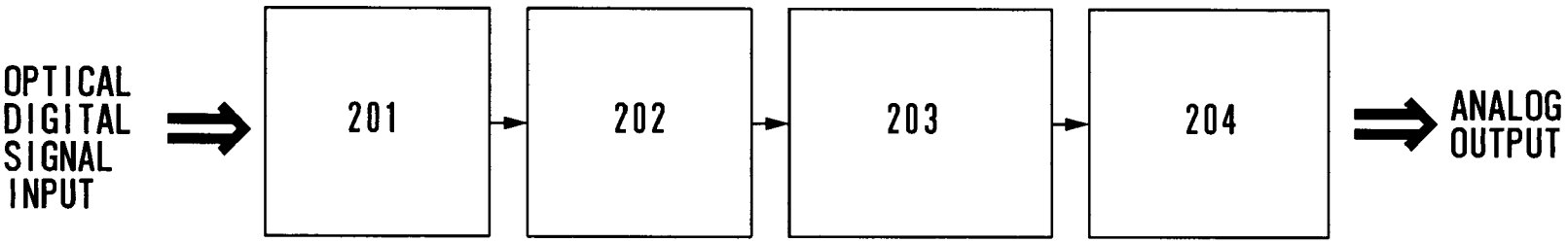
FIG. 2 illustrates a block diagram of an audio signal processing circuit.
Figure 3:
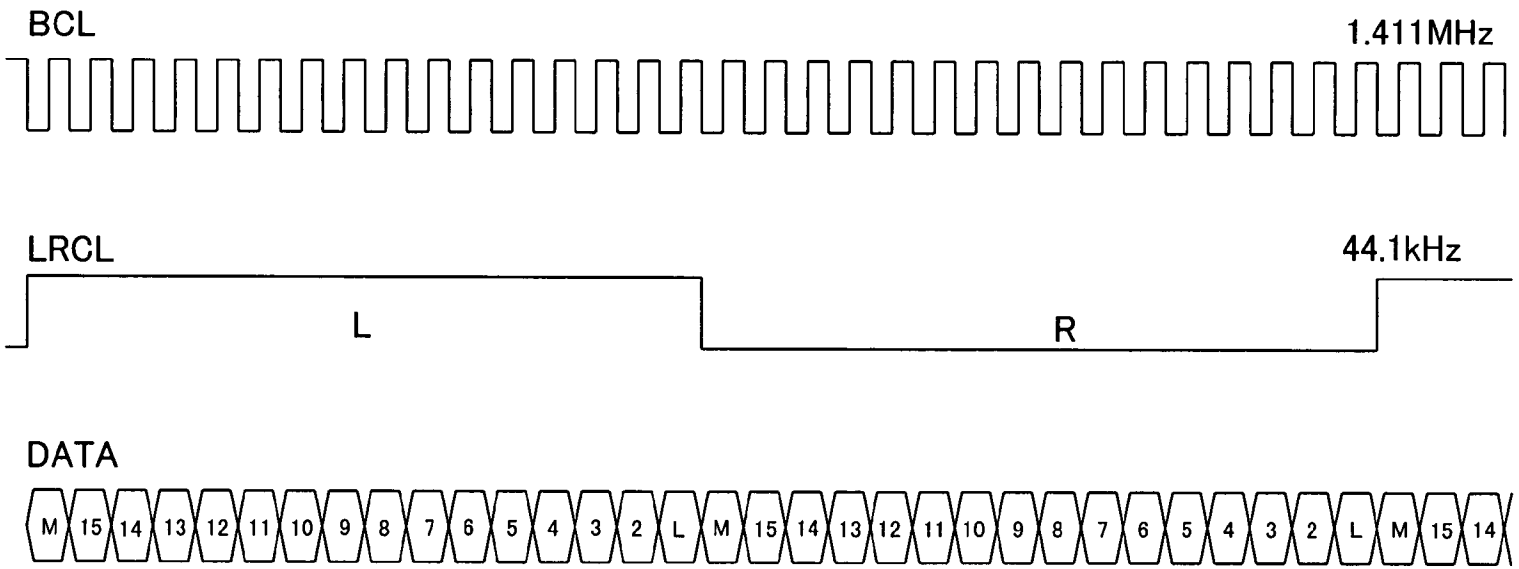
FIG. 3 illustrates a diagram of a digital signal of a CD.

FIG. 1 is a diagram showing Embodiment Mode 1 of the invention. As shown in FIG. 1, the circuit of this embodiment mode includes a D/A converter circuit 101, a power supply 102 for the D/A converter circuit 101, a speaker connecting portion 108 and a signal line driver circuit 109. A digital audio signal input to the D/A converter circuit 101 is converted into an analog audio signal and electrically connected to the speaker connecting portion 108. Although the description is based on the speaker drive in FIG. 1, the speaker connecting portion 108 is not necessarily provided and it can be replaced by other elements.

Figure 4:
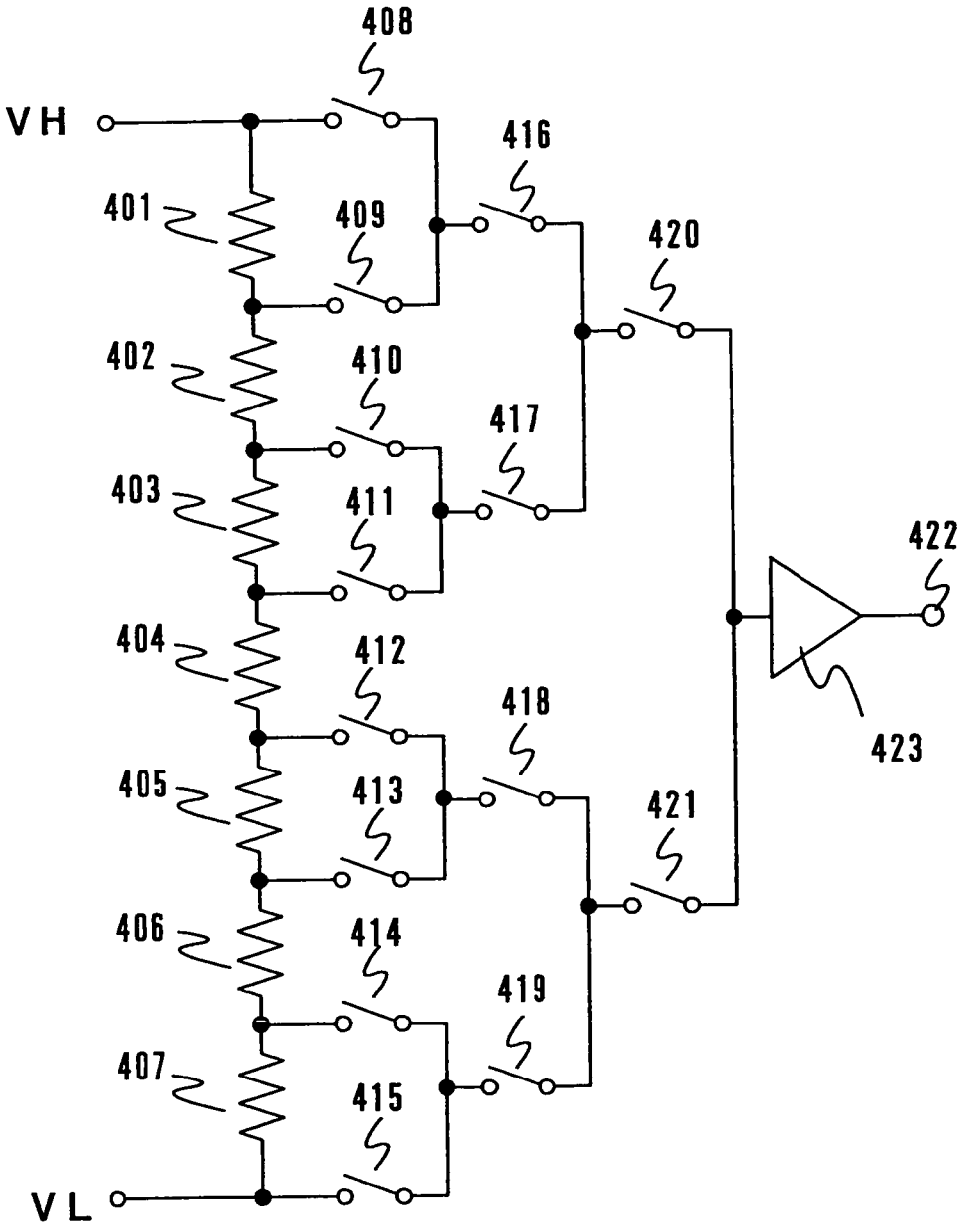
FIG. 4 PRIOR ART
FIG. 4 illustrates a circuit diagram of a conventional resistor string D/A converter circuit.
Figure 5:
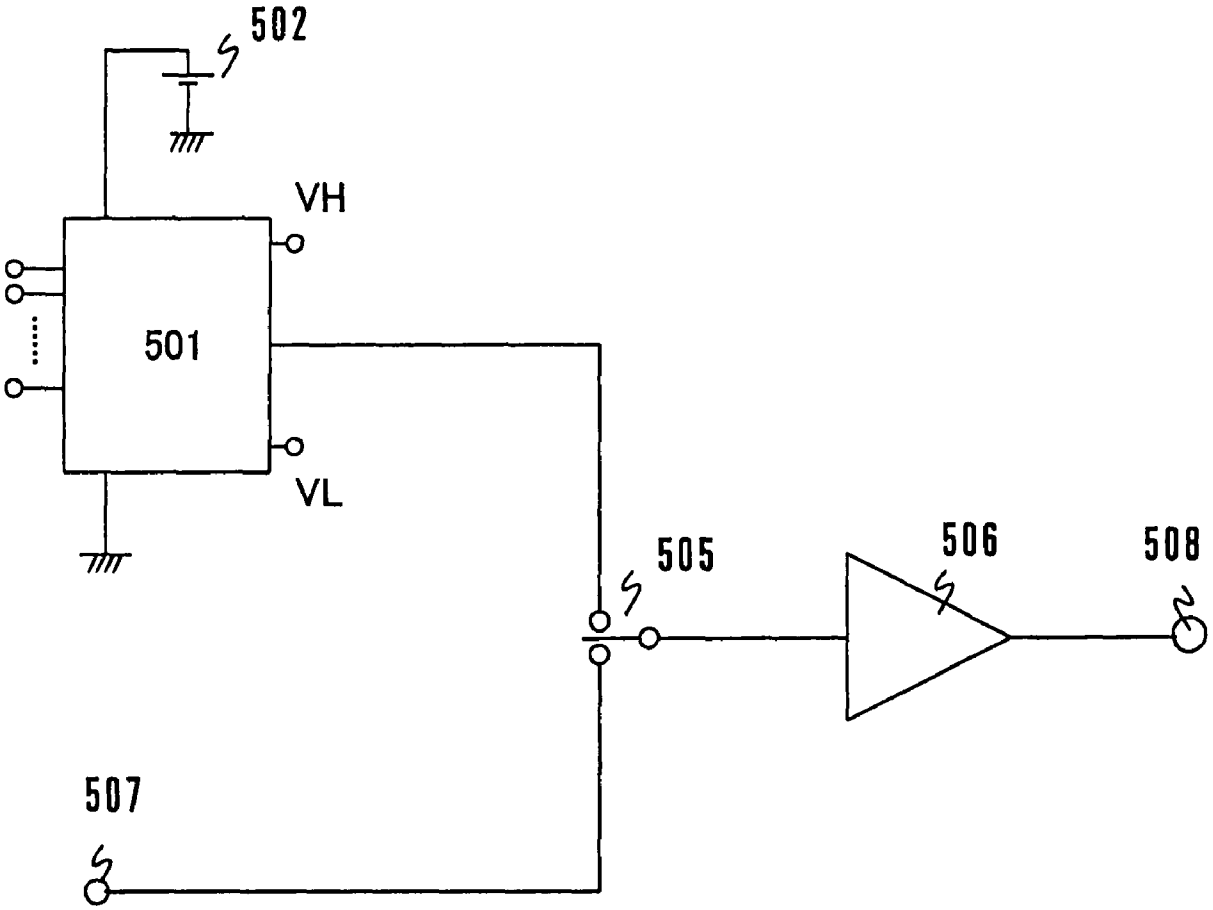
FIG. 5 PRIOR ART
FIG. 5 illustrates a circuit diagram of an audio signal processing circuit of a conventional liquid crystal display device.

The D/A converter circuit 101 of this embodiment mode has a similar configuration to the conventional D/A converter circuit shown in FIG. 4. However, the D/A converter circuit 101 is connected to the same power supply voltage as the signal line driver circuit 109 of the display device so as to obtain a high output voltage from the D/A converter circuit. A liquid crystal display device in general includes at least one source signal line and one gate signal line, and a pixel is disposed at their intersection. In particular, in a liquid crystal display device using polysilicon TFTs, a source signal line driver circuit and a gate signal line driver circuit are incorporated. Generally, a signal line driver circuit of a liquid crystal display device requires, in particular, a gate signal line driver circuit requires a high level power supply voltage in the range of, for example, 16 to 20 V. Accordingly, in an audio signal processing circuit which integrates such a signal line driver circuit, a power supply voltage of 16 to 20 V can be obtained without additionally providing a high power supply voltage.

According to the invention, the D/A converter circuit 101 is connected to the same power supply voltage as the signal line driver circuit 109. For example, when the power supply 102 for the D/A converter circuit 101 is set at 16 V, the D/A converter circuit 101 can output a signal having an amplitude of 5 V or more. That is, when the VH is at 12 V while the VL is at 4 V, the D/A converter circuit 101 can output a signal having an amplitude of 8 Vpp at largest, which means the S/N ratio can be suppressed to 1/800 even when a glitch of about 10 mV is generated as in the conventional D/A converter circuit.

Embodiment Mode 2

Figure 20:
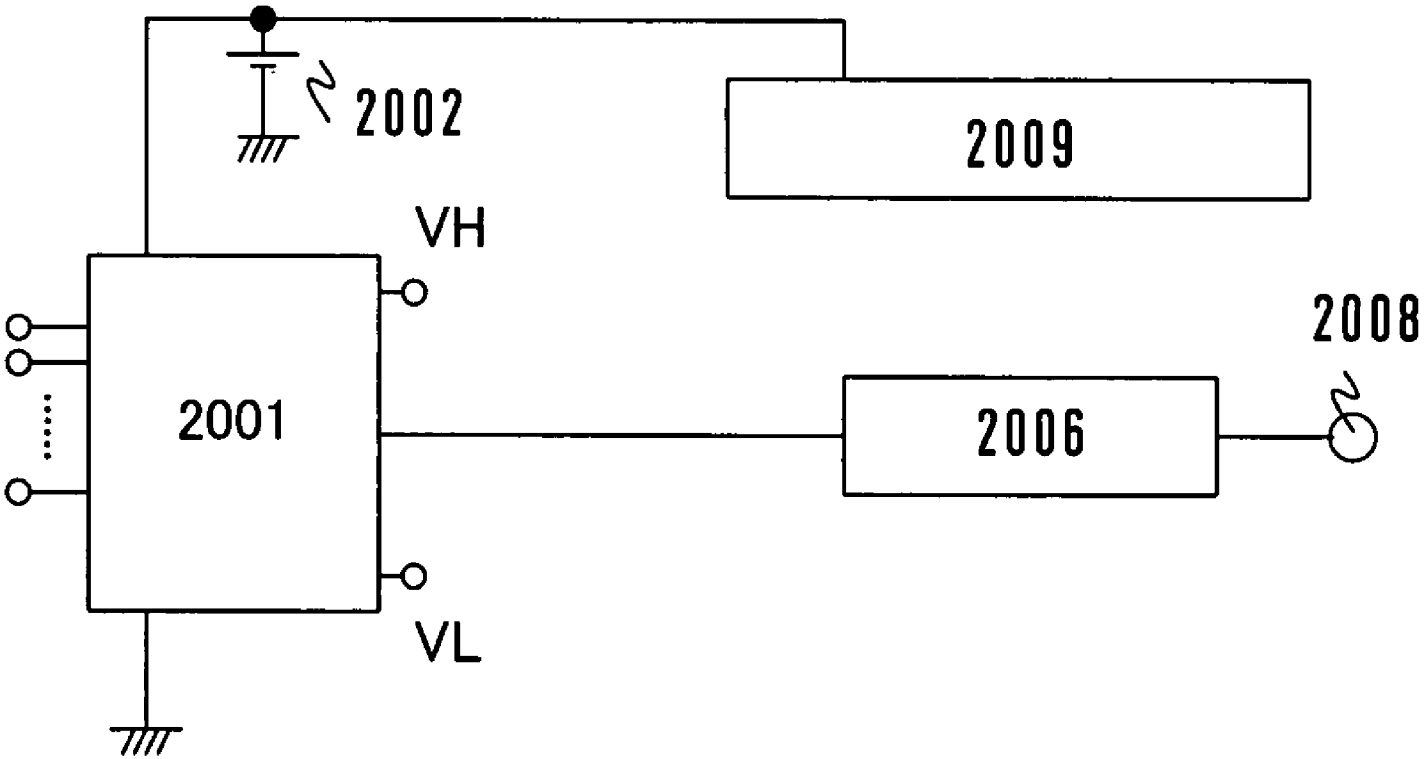
FIG. 20 illustrates an embodiment mode of an audio signal processing circuit of the liquid crystal display device of the invention.

FIG. 20 is a diagram showing Embodiment Mode 2 of the invention. As shown in FIG. 20, the circuit of this embodiment mode includes a D/A converter circuit 2001, a power supply 2002 for the D/A converter circuit 2001, a speaker connecting portion 2008, a signal line driver circuit 2009 and an amplifier circuit 2006. A digital audio signal input to the D/A converter circuit 2001 is converted into an analog audio signal. The amplifier circuit 2006 amplifies the analog audio signal converted in the D/A converter circuit 2001. The amplifier circuit 2006 is electrically connected to the speaker connecting portion 2008. Depending on the level of an output signal, the amplifier circuit 2006 may be replaced by an attenuator circuit to attenuate the analog audio signal for output. Although the description is based on the speaker drive in FIG. 20, the speaker connecting portion 2008 is not necessarily provided and it can be replaced by other elements.

As in Embodiment Mode 1, the D/A converter circuit 2001 is connected to the same power supply voltage 2002 as the signal line driver circuit 2009, enabling an output signal of the D/A converter circuit 2001 to have a large amplitude. Thus, an influence of a glitch can be reduced.

Embodiment Mode 3

Figure 17:
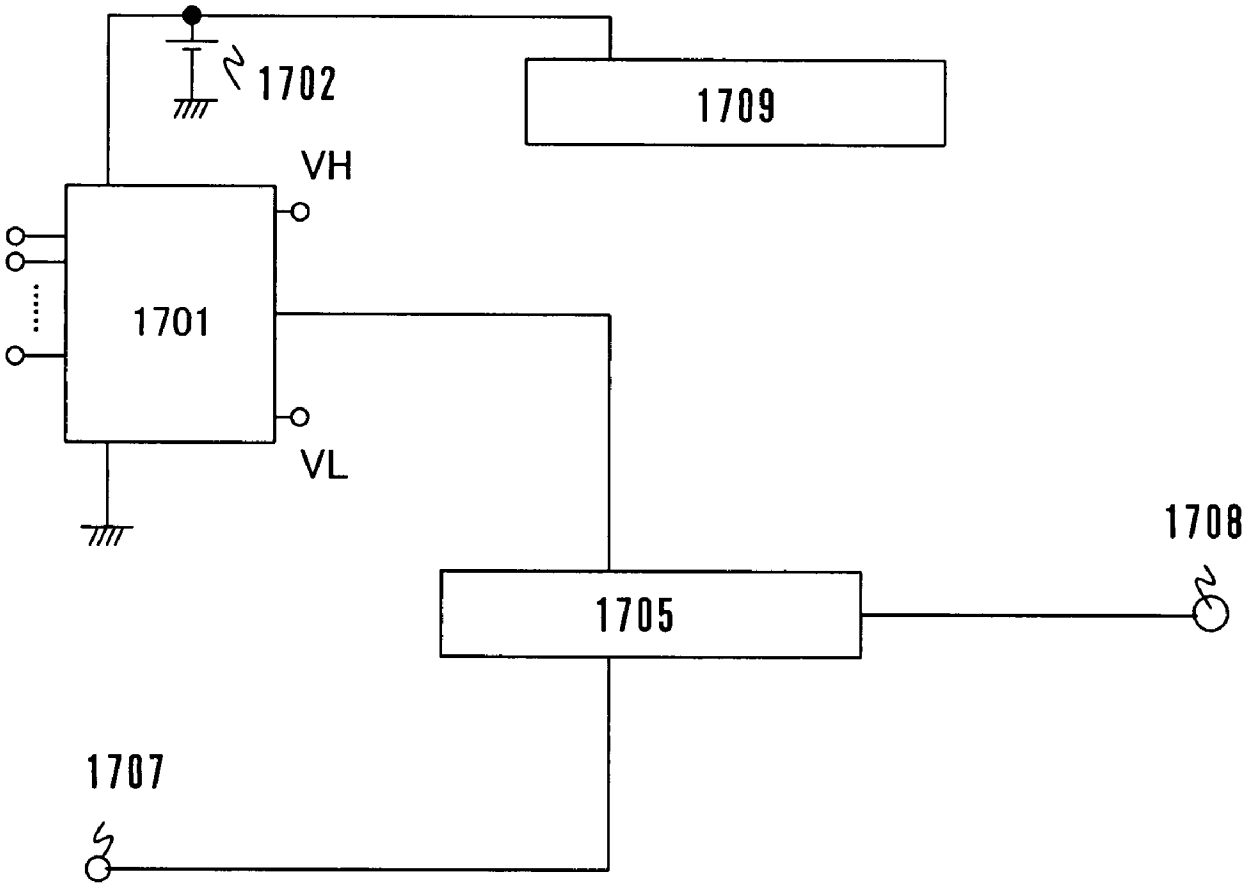
FIG. 17 illustrates an embodiment mode of an audio signal processing circuit of the liquid crystal display device of the invention.

FIG. 17 is a diagram showing Embodiment Mode 3 of the invention. As shown in FIG. 17, the circuit of this embodiment mode includes a D/A converter circuit 1701, a power supply 1702 for the D/A converter circuit 1701, a speaker connecting portion 1708, a signal line driver circuit 1709, a switch circuit 1705 and an analog audio signal input terminal 1707. A digital audio signal input to the D/A converter circuit 1701 is converted into an analog audio signal while another analog audio signal is externally input to the analog audio signal input terminal 1707. The switch circuit 1705 selects either of the analog audio signal converted in the D/A converter circuit 1701 or the analog audio signal input from the analog audio signal input terminal 1707. The switch circuit 1705 can be replaced by a switch element. The switch circuit 1705 is electrically connected to the speaker connecting portion 1708. Selection is performed by two signals in FIG. 17, however, three or more signals can be employed as well. In addition, although the description is based on the speaker drive in FIG. 17, the speaker connecting portion 1708 is not necessarily provided and it can be replaced by other elements.

As in Embodiment Mode 1, the D/A converter circuit 1701 is connected to the same power supply voltage 1702 as the signal line driver circuit 1709, enabling an output signal of the D/A converter circuit 1701 to have a large amplitude. Thus, an influence of a glitch can be reduced.

Embodiment Mode 4

Figure 21:
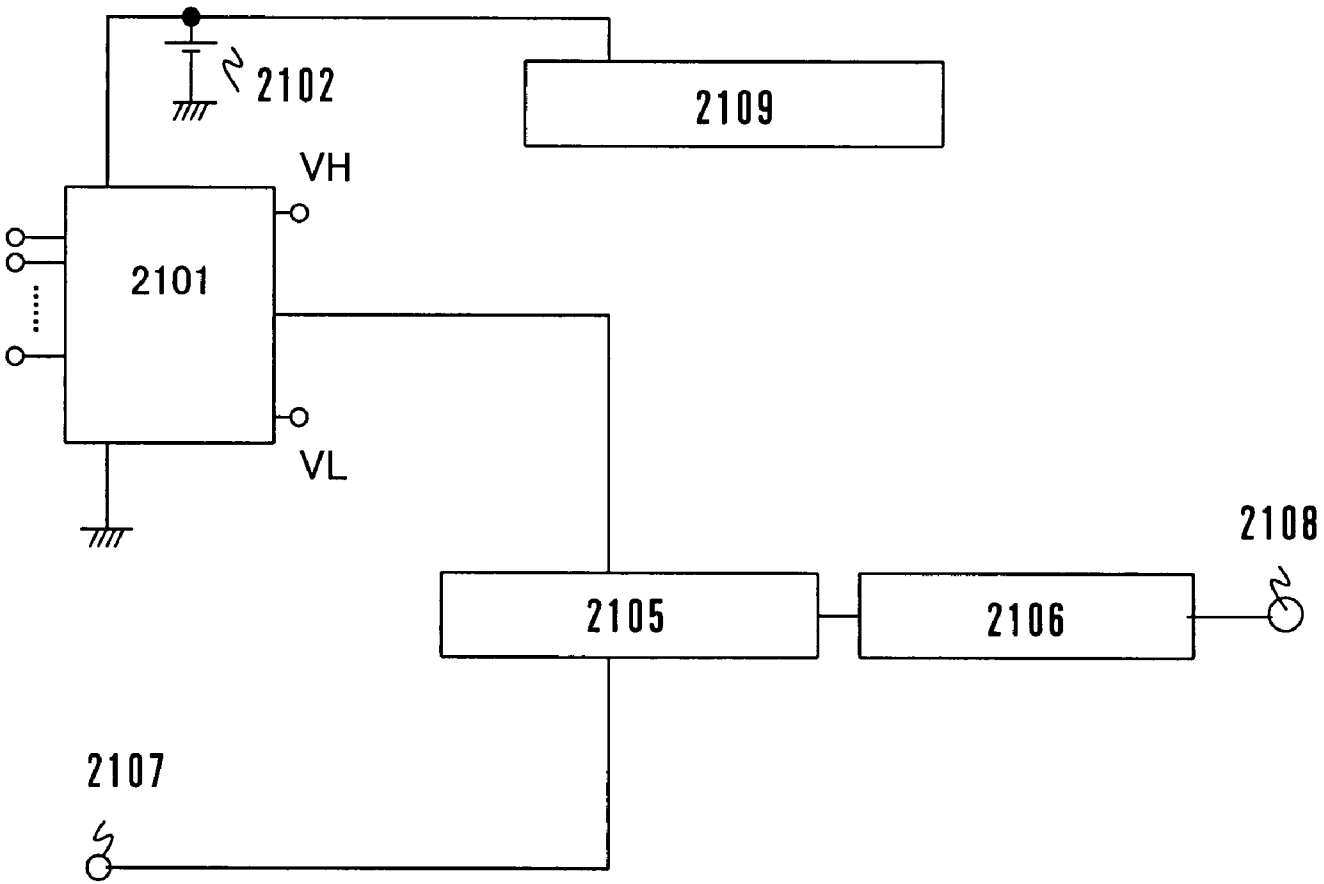
FIG. 21 illustrates an embodiment mode of an audio signal processing circuit of the liquid crystal display device of the invention.

FIG. 21 is a diagram showing Embodiment Mode 4 of the invention. As shown in FIG. 21, the circuit of this embodiment mode includes a D/A converter circuit 2101, a power supply 2102 for the D/A converter circuit 2101, a speaker connecting portion 2108, a signal line driver circuit 2109, a switch circuit 2105, an analog audio signal input terminal 2107 and an amplifier circuit 2106. A digital audio signal input to the D/A converter circuit 2101 is converted into an analog audio signal while another analog audio signal is externally input to the analog audio signal input terminal 1707. The switch circuit 2105 selects either of the analog audio signal converted in the D/A converter circuit 2105 or the analog audio signal input to the analog audio signal input terminal 2107. The switch circuit 2105 can be replaced by a switch element. The switch circuit 2105 is electrically connected to the amplifier circuit 2106. The amplifier circuit 2106 amplifies an analog audio signal and electrically connected to the speaker connecting portion 2108. Selection is performed by two signals in FIG. 17, however, three or more signals can be employed as well. In addition, although the description is based on the speaker drive in FIG. 21, the speaker connecting portion 2108 is not necessarily provided and it can be replaced by other elements.

The D/A converter circuit 2101 of this embodiment mode has a similar configuration to the conventional D/A converter circuit as in Embodiment Mode 1. However, the D/A converter circuit 2101 is connected to the same power supply voltage 2102 as the signal line driver circuit 2109, enabling an output signal of the D/A converter circuit 2101 to have a large amplitude. Thus, an influence of a glitch can be reduced.

Embodiment Mode 5

Figure 18:
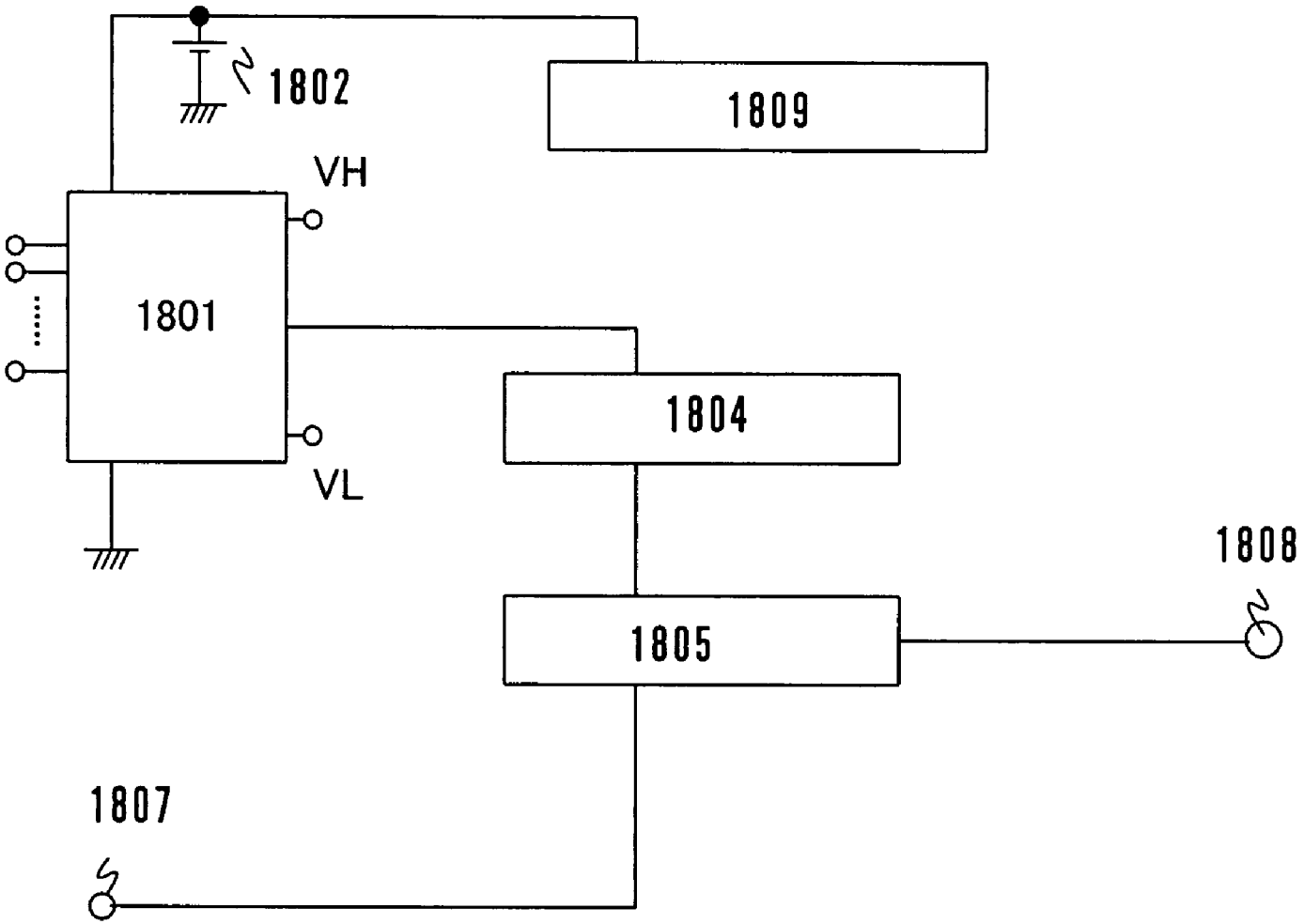
FIG. 18 illustrates an embodiment mode of an audio signal processing circuit of the liquid crystal display device of the invention.

FIG. 18 is a diagram showing an embodiment mode of the invention. As shown in FIG. 18, the circuit of this embodiment mode includes a D/A converter circuit 1801, a power supply 1802 for the D/A converter circuit 1801, a speaker connecting portion 1808, a signal line driver circuit 1809, a switch circuit 1805, an analog audio signal input terminal 1807 and a correction circuit 1804. A digital audio signal input to the D/A converter circuit 1801 is converted into an analog audio signal while another analog audio signal is externally input to the analog audio signal input terminal 1807. The correction circuit 1804 adjusts the output signal of the D/A converter circuit 1801 to match the signal of the analog audio signal input terminal 1807 in levels. The switch circuit 1805 selects either of the analog audio signal of which level is corrected in the correction circuit 1804 or the analog audio signal input to the analog audio signal input terminal 1807. The switch circuit 1805 can be replaced by a switch element. The switch circuit 1805 is electrically connected to the speaker connecting portion 1808. Selection is performed by two signals in FIG. 18, however, three or more signals can be employed for the selection. In addition, although the description is based on the speaker drive in FIG. 18, the speaker connecting portion is not necessarily provided and it can be replaced by other elements.

As in Embodiment Mode 1, the D/A converter circuit 1801 is connected to the same power supply voltage 1802 as the signal line driver circuit 1809, enabling an output signal of the D/A converter circuit 1801 to have a large amplitude. Thus, an influence of a glitch can be reduced.

The correction circuit 1804 is disposed between the D/A converter circuit 1801 and the switch circuit 1805 in FIG. 18, however, the invention is not limited to this. It may be disposed between the analog audio signal input terminal 1807 and the switch circuit 1805 as well. Alternatively, a correction circuit may be disposed between the D/A converter circuit 1801 and the switch circuit 1805 and between the analog audio signal input terminal 1807 and the switch circuit 1805.

Embodiment Mode 6

Figure 19:
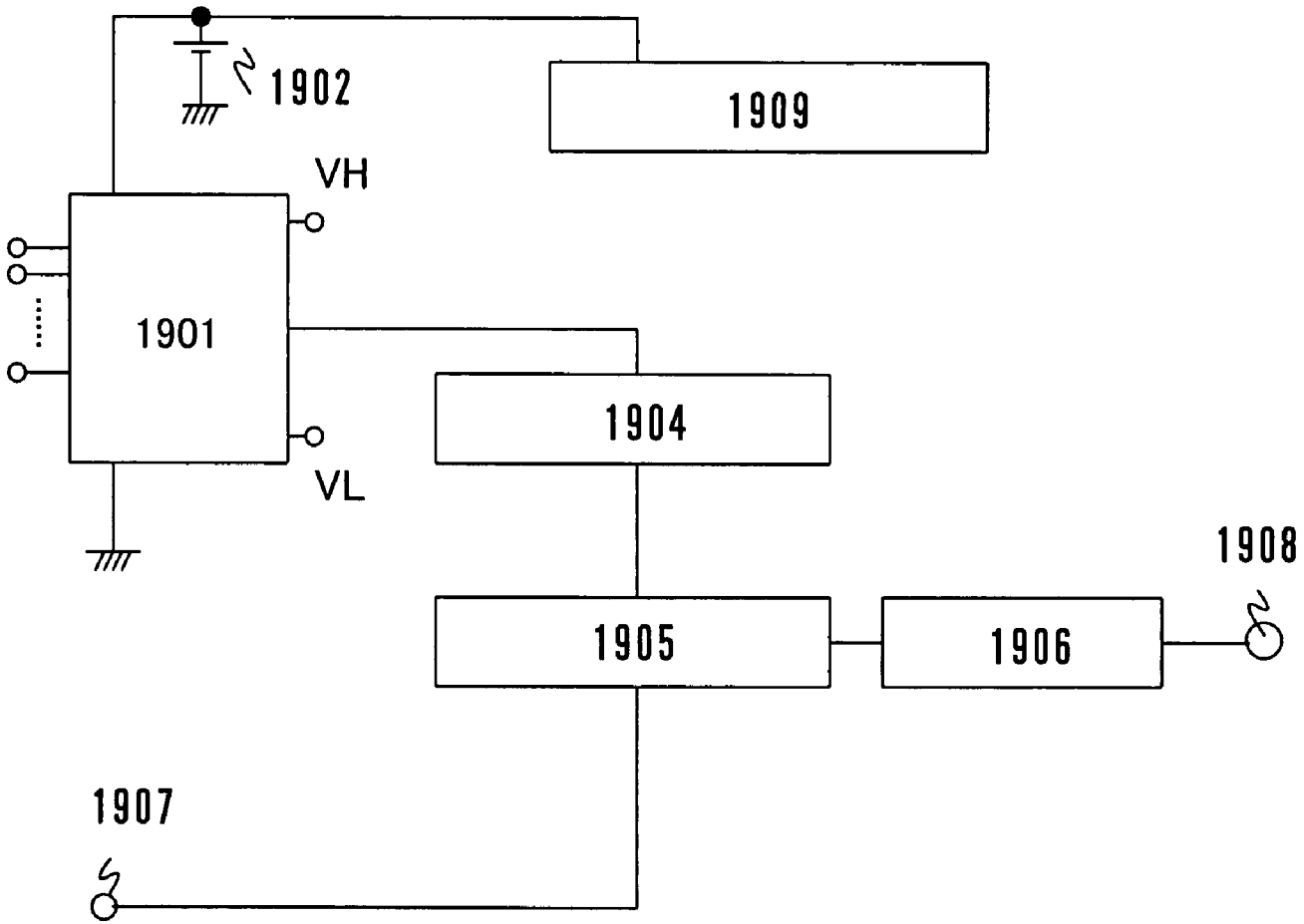
FIG. 19 illustrates an embodiment mode of an audio signal processing circuit of the liquid crystal display device of the invention.

FIG. 19 is a diagram showing Embodiment Mode 6 of the invention. As shown in FIG. 19, the circuit of this embodiment mode includes a D/A converter circuit 1901, a power supply 1902 for the D/A converter circuit 1901, a speaker connecting portion 1908, a signal line driver circuit 1909, a switch circuit 1905, an analog audio signal input terminal 1907, a correction circuit 1904 and an amplifier circuit 1906. A digital audio signal input to the D/A converter circuit 1901 is converted into an analog audio signal while another analog audio signal is externally input to the analog audio signal input terminal 1907. The correction circuit 1904 adjusts the output signal of the D/A converter circuit 1901 to match the signal of the analog audio signal input terminal 1907 in levels. The switch circuit 1905 selects either of the analog audio signal of which level is corrected in the correction circuit 1904 or the analog audio signal input to the analog audio signal input terminal 1907. The switch circuit 1905 can be replaced by a switch element. The amplifier circuit 1906 has a function to amplify an output signal of the switch circuit 1905. The amplifier circuit 1906 is electrically connected to the speaker connecting portion 1908. Selection is performed by two signals in FIG. 19, however, three or more signals can be employed for the selection. In addition, although the description is based on the speaker drive in FIG. 19, the speaker connecting portion is not necessarily provided and it can be replaced by other elements.

As in Embodiment Mode 1, the D/A converter circuit 1901 is connected to the same power supply voltage 1902 as the signal line driver circuit 1909, enabling an output signal of the D/A converter circuit 1901 to have a large amplitude. Thus, an influence of a glitch can be reduced.

The correction circuit 1904 is disposed between the D/A converter circuit 1901 and the switch circuit 1905 in FIG. 19, however, the invention is not limited to this. It may be disposed between the analog audio signal input terminal 1907 and the switch circuit 1905 as well. Alternatively, a correction circuit may be disposed between the D/A converter circuit 1901 and the switch circuit 1905 and between the analog audio signal input terminal 1907 and the switch circuit 1905.

As described above, in this embodiment mode, a glitch level relatively to an audio signal can be suppressed by using the common power supply voltage for the D/A converter circuit and the signal line driver circuit, thus the S/N ratio of the output signal of the D/A converter circuit can be improved. In addition, by attenuating the output signal of the D/A converter circuit, the output signal of the D/A converter circuit can be adjusted to match the other analog audio signal which is input externally in levels.

Accordingly, high-quality audio data can be supplied to users.

Embodiment 1

Figure 22:
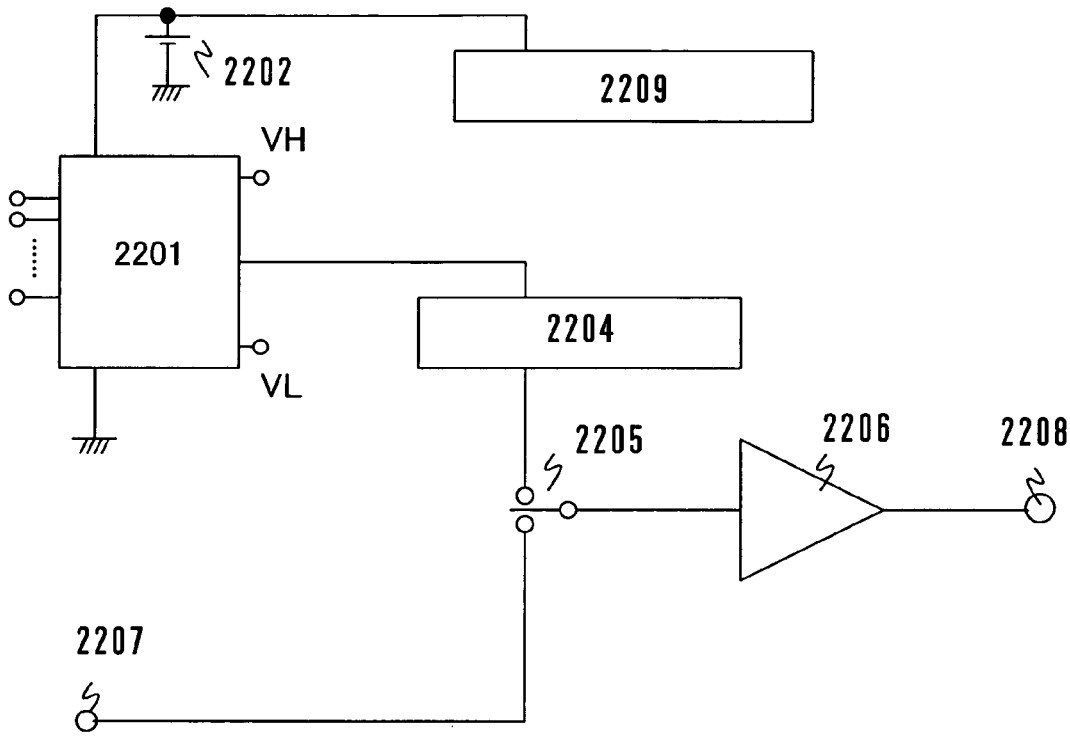
FIG. 22 illustrates an embodiment of an audio signal processing circuit of the liquid crystal display device of the invention.

FIG. 22 is a diagram showing Embodiment 1 of the invention. As shown in FIG. 22, a circuit of this embodiment mode includes a D/A converter circuit 2201, a power supply 2202 for the D/A converter circuit 2201, an attenuator circuit 2204, an amplifier circuit 2206, an analog audio signal input terminal 2207, a D/A selection switch 2205, a speaker connecting portion 2208 and a signal line driver circuit 2209. Description is given below on the assumption that the signal level of the analog audio signal input terminal 2207 is at 283 mVpp while the signal level of the speaker connecting portion 2208 is at 10 Vpp as in the conventional circuit.

In this embodiment, the D/A converter circuit 2201 is connected to the same power supply voltage as the signal line driver circuit 2209 to obtain a high level voltage. For example, when the power supply 2202 for the D/A converter circuit 2201 is set at 16 V, the D/A converter circuit 2201 can obtain an output voltage having an amplitude of 5 V or more. That is, when the VH is at 12 V while the VL is at 4 V, the D/A converter circuit 2202 can obtain an output voltage having an amplitude of 8 Vpp at largest, which means the S/N ratio can be suppressed to 1/800 even when a glitch of about 10 mV is generated as in the conventional D/A converter circuit.

On the other hand, an analog audio signal input to the analog audio signal input terminal 2207 is at 283 mVpp as in the conventional circuit. Therefore, the output signal of the D/A converter circuit 2201 passes through the attenuator circuit 2204 to adjust the signal levels between an analog signal input and a digital signal input. It should be noted that the attenuator circuit 2204 is one of the correction circuits for adjusting the level of audio signals. Specifically, when the attenuation ratio of the attenuator circuit 2204 is set at 0.035 times, the attenuator circuit 2204 can output a signal at a level of 283 mVpp. Accordingly, the input signal of the amplifier circuit 2206 can be at a level of 283 mVpp in either case of the analog signal input or the digital signal input. Assuming that a gain of the amplifier circuit 2206 is 35.3 times, the output voltage of the speaker connecting portion 2208 is at 10 Vpp and about 3.5 Vrms in the case of selecting either the analog signal input or the digital signal input by the D/A selection switch 2205.

It should be noted that the gain as described above is only an example, and therefore, the invention is not limited to this and it can be set appropriately. Alternatively, the amplifier circuit 2206 can be removed when a small output voltage is required.

As described above, in this embodiment mode, a glitch level relatively to an audio signal can be suppressed by using the common power supply voltage for the D/A converter circuit and the signal line driver circuit, thus the S/N ratio of the output signal of the D/A converter circuit can be improved. In addition, by amplifying the output signal of the D/A converter circuit, the output signal of the D/A converter circuit can be adjusted to match the other analog audio signal which is input externally in levels.

Accordingly, high-quality audio data can be supplied to users.

Embodiment 2

Figure 7:
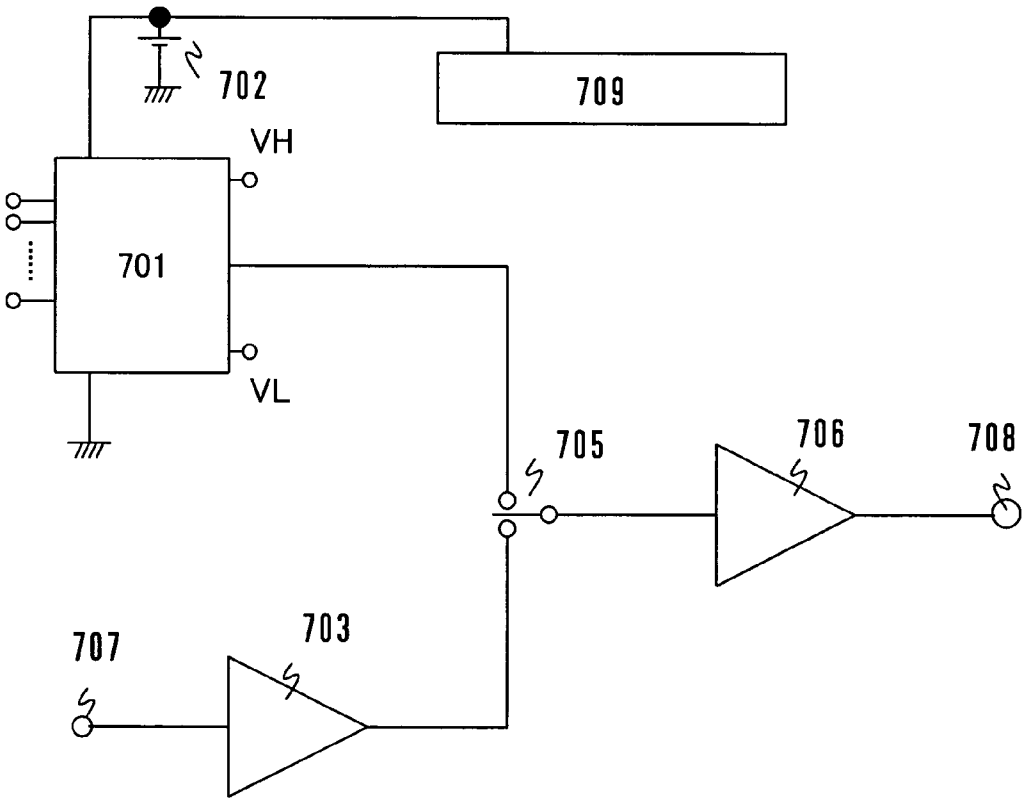
FIG. 7 illustrates an embodiment of an audio signal processing circuit of the liquid crystal display device of the invention.

FIG. 7 is a diagram showing Embodiment 2 of the invention. As shown in FIG. 7, the circuit of this embodiment mode includes a D/A converter circuit 701, a power supply 702 for the D/A converter circuit 701, a first amplifier circuit 703, a second amplifier circuit 706, an analog audio signal input terminal 707, a D/A selection switch 705, a speaker connecting portion 708 and a signal line driver circuit 709. Description is given below on the assumption that the signal level of the analog audio signal input terminal 707 is at 283 mVpp while the signal level of the speaker connecting portion 708 is at 10 Vpp as in the conventional circuit.

In this embodiment, the D/A converter circuit 701 is connected to the same power supply voltage as the signal line driver circuit 709 to obtain a high level voltage. For example, when the power supply 702 for the D/A converter circuit 701 is set at 16 V, the D/A converter circuit 701 can obtain an output voltage having an amplitude of 5 V or more. That is, when the VH is at 12 V while the VL is at 4 V, the D/A converter circuit 702 can obtain an output voltage having an amplitude of 8 Vpp at largest, which means the S/N ratio can be suppressed to 1/800 even when a glitch of about 10 mV is generated as in the conventional D/A converter circuit.

On the other hand, an analog audio signal input to the analog audio signal input terminal 707 is at 283 mVpp as in the conventional circuit. Therefore, only an analog signal passes through the attenuator circuit 703 to adjust the signal levels between an analog signal input and a digital signal input. It should be noted that the first amplifier circuit 703 is one of the correction circuits for adjusting the level of audio signals. Specifically, when the amplification ratio of the first amplifier circuit 703 is set at 28.3 times, the first amplifier circuit 703 can output a signal of 8 V. Accordingly, the input signal of the second amplifier circuit 706 can be at a level of 8 V in either case of the analog signal input or the digital signal input. Assuming that a gain of the second amplifier circuit 706 is 1.25 times, the output voltage of the speaker connecting portion 708 is at 10 Vpp and about 3.5 Vrms in the case of selecting either the analog signal input or the digital signal input by the D/A selection switch 705.

It should be noted that the gain as described above is only an example. Therefore, the invention is not limited to this and it can be set appropriately. Alternatively, the second amplifier circuit 706 can be removed when a small output voltage is required.

As described above, in this embodiment mode, a glitch level relatively to an audio signal can be suppressed by using the common power supply voltage for the D/A converter circuit and the signal line driver circuit, thus the S/N ratio of the output signal of the D/A converter circuit can be improved. In addition, by amplifying only the analog signals, the analog signal can be adjusted to match analog audio signals in levels.

Accordingly, high-quality audio data can be supplied to users.

Embodiment 3

Figure 8:
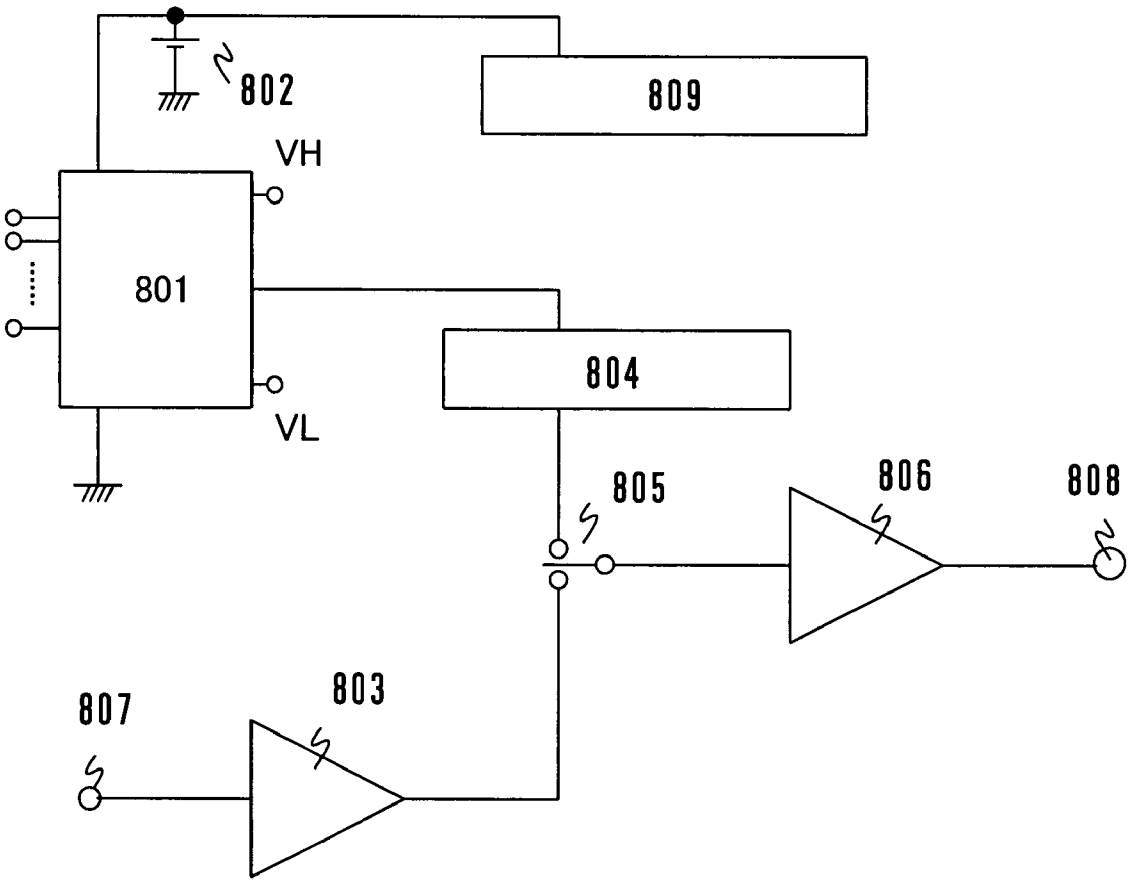
FIG. 8 illustrates an embodiment of an audio signal processing circuit of the liquid crystal display device of the invention.

FIG. 8 is a diagram showing an embodiment of the invention. As shown in FIG. 8, the circuit of this embodiment mode includes a D/A converter circuit 801, a power supply 802 for the D/A converter circuit 801, an attenuator circuit 804, a first amplifier circuit 803, a second amplifier circuit 806, an analog audio signal input terminal 807, a D/A selection switch (switch for selecting a digital input or an analog input) 806, a speaker connecting portion 808, and a signal line driver circuit 809. Description is given below on the assumption that the signal level of the analog audio signal input terminal 807 is at 283 mVpp while the signal level of the speaker connecting portion 808 is at 10 Vpp as in the conventional circuit.

In this embodiment, the D/A converter circuit 801 is connected to the same power supply voltage as the signal line driver circuit 809 to obtain a high level voltage. For example, when the power supply 802 for the D/A converter circuit 801 is set at 16 V, the D/A converter circuit 801 can obtain an output voltage having an amplitude of 5 V or more. That is, when the VH is at 12 V while the VL is at 4 V, the D/A converter circuit 802 can obtain an output voltage having an amplitude of 8 Vpp at largest, which means the S/N ratio can be suppressed to 1/800 even when a glitch of about 10 mV is generated as in the conventional D/A converter circuit.

On the other hand, since an analog audio signal input to the analog audio signal input terminal 807 is at 283 mVpp as in the conventional circuit, a gain at a digital signal input has to be lowered down to 0.0353 times so that the signal levels can be equal to each other between the analog signal input and the digital signal input. In this embodiment, the output of the D/A converter circuit 801 is attenuated in the attenuator circuit 804 while the analog signal input externally is amplified in the amplifier circuit 803. It should be noted that each of the attenuator circuit 804 and the amplifier circuit 803 is one of the correction circuits for adjusting the level of audio signals. Specifically, when the attenuation ratio of the attenuator circuit 804 is set at 0.177 times while the gain of the first amplifier circuit 803 is set at five times, the input of the second amplifier circuit 806 is at 1.41 Vppa in either case of the analog signal input or the digital signal input. When a gain of the second amplifier circuit 806 is set at 7.09 times, the amplitude of the speaker connection terminal 808 can be at 10 Vpp and about 3.54 Vrms.

It should be noted that the gain as described above is only an example. Therefore, the invention is not limited to this and it can be set appropriately. Alternatively, the second amplifier circuit 806 can be removed when a small output voltage is required.

As described above, in this embodiment mode, a glitch level relatively to an audio signal can be suppressed by using the common power supply voltage for the D/A converter circuit and the signal line driver circuit, thus the S/N ratio of the output signal of the D/A converter circuit can be improved. In addition, by inputting to the D/A selection switch the output signal of the D/A converter circuit through attenuation in the attenuator circuit or the signal which is input externally through amplification in the analog signal amplifier circuit, each of the signals can be adjusted to be equal in levels.

Accordingly, high-quality audio data can be supplied to users.

Embodiment 4

Figure 9:
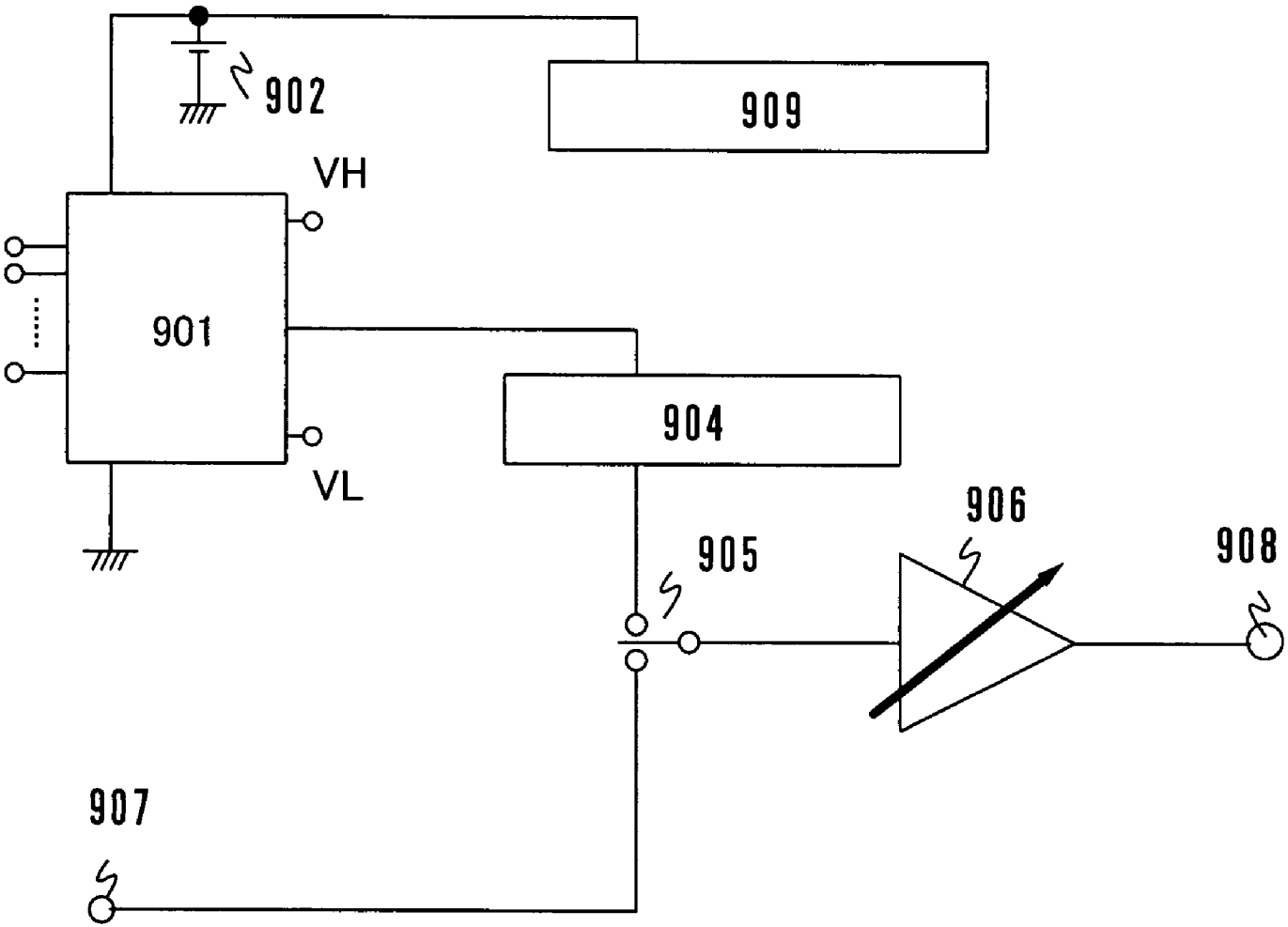
FIG. 9 illustrates an embodiment of an audio signal processing circuit of the liquid crystal display device of the invention.

FIG. 9 is a diagram showing Embodiment 4 of the invention. As shown in FIG. 9, the circuit of this embodiment includes a D/A converter circuit 901, a power supply 902 for the D/A converter circuit 901, an attenuator circuit 914, an amplifier circuit 906, an analog audio signal input terminal 907, a D/A selection switch 905, a speaker connecting portion 908 and a signal line driver circuit 909. Description is given below on the assumption that the signal level of the analog audio signal input terminal 907 is at 283 mVpp while the signal level of the speaker connecting portion 908 is at 10 Vpp as in the conventional circuit.

In this embodiment, the D/A converter circuit 901 is connected to the same power supply voltage as the signal line driver circuit 909 to obtain a high level voltage. For example, when the power supply 902 for the D/A converter circuit 901 is set at 16 V, the D/A converter circuit 901 can obtain an output voltage having an amplitude of 5 V or more. That is, when the VH is at 12V while the VL is at 4 V, the D/A converter circuit 901 can obtain an output voltage having an amplitude of 8 Vpp at largest, which means the S/N ratio can be suppressed to 1/800 even when a glitch of about 10 mV is generated as in the conventional D/A converter circuit.

On the other hand, since an analog audio signal input to the analog audio signal input terminal 907 is at 283 mVpp as in the conventional circuit, a gain at a digital signal input has to be lowered down to 0.0353 times so that the signal levels can be equal to each other between the analog signal input and the digital signal input. Setting in this embodiment is as follows. The output signal of the D/A converter circuit 901 is attenuated in the attenuator circuit 904. In addition, a gain of the amplifier circuit 906 is changed between an analog signal input and a digital signal input. It should be noted that each of the attenuator circuit 904 and the amplifier circuit 906 is one of the correction circuits for adjusting the level of audio signals.

Specifically, when the attenuation ratio of the attenuator circuit 904 is set at 0.177 times while the gain of the amplifier circuit 906 is set at 35.4 times in the case of an analog signal input and 7.09 times in the case of a digital signal input, the speaker connecting portion 908 can output a signal at a level of 10 Vpp in either case of an analog signal input or a digital signal input.

It should be noted that the gain as described above is only an example. Therefore, the invention is not limited to this and it can be set appropriately. Alternatively, the attenuator circuit 904 can be removed when the amplifier circuit 906 can obtain a wide ranged gain.

As described above, in this embodiment mode, a glitch level relatively to an audio signal can be suppressed by using the common power supply voltage for the D/A converter circuit and the signal line driver circuit, thus S/N ratio of the output signal of the D/A converter circuit can be improved. In addition, by attenuating the output signal of the D/A converter circuit 901 in the attenuator circuit 904 and changing the gain of the amplifier circuit 906 between an analog signal input and a digital signal input, each of the signals can be set equal in levels in either case of the analog signal input or the digital signal input.

Accordingly, high-quality audio data can be supplied to users.

Embodiment 5

Figure 10:
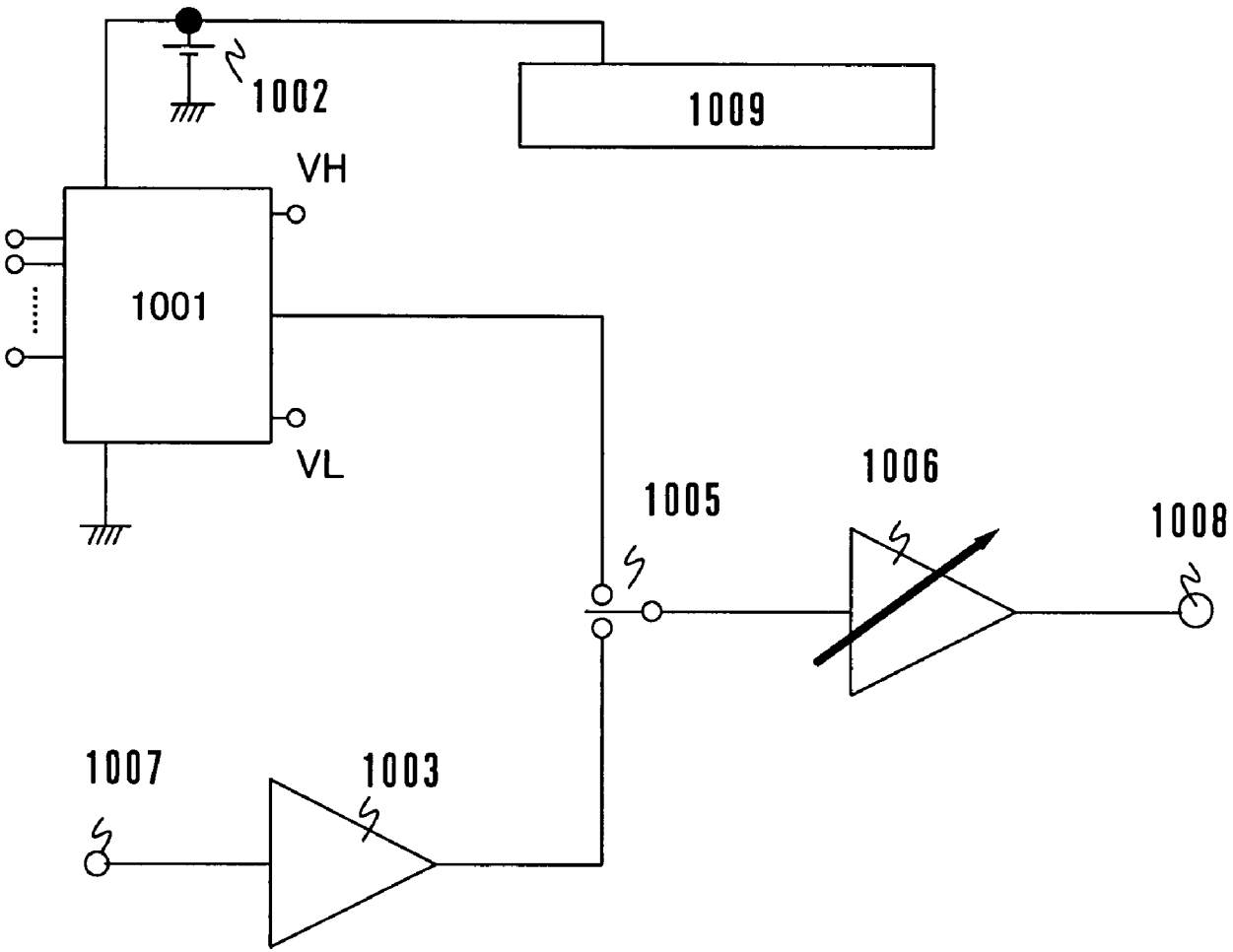
FIG. 10 illustrates an embodiment of an audio signal processing circuit of the liquid crystal display device of the invention.

FIG. 10 is a diagram showing Embodiment 5 of the invention. As shown in FIG. 10, the circuit of this embodiment includes a D/A converter circuit 1001, a power supply 1002 for the D/A converter circuit 1001, a first amplifier circuit 1003, a second amplifier circuit 1006, an analog audio signal input terminal 1007, a D/A selection switch 1005, a speaker connecting portion 1008 and a signal line driver circuit 1009. Description is given below on the assumption that the signal level of the analog audio signal input terminal 1007 is at 283 mVpp while the signal level of the speaker connecting portion 1008 is at 10 Vpp as in the conventional circuit.

In this embodiment, the D/A converter circuit 1001 is connected to the same power supply voltage as the signal line driver circuit 1009 to obtain a high level voltage. For example, when the power supply 1002 for the D/A converter circuit 1001 is set at 16 V, the D/A converter circuit 1001 can obtain an output voltage having an amplitude of 5 V or more. That is, when the VH is at 12 V while the VL is at 4 V, the D/A converter circuit 1002 can obtain an output voltage having an amplitude of 8 Vpp at largest, which means the S/N ratio can be suppressed to 1/800 even when a glitch of about 10 mV is generated as in the conventional D/A converter circuit.

On the other hand, since an analog audio signal input to the analog audio signal input terminal 1007 is at 283 mVpp as in the conventional circuit, a gain has to be changed between an analog signal input and a digital signal input so that the each of signal levels is adjusted to be equal to each other. In this embodiment, signal levels are adjusted by passing only an analog signal through the first amplifier circuit 1003 and changing a gain of the second amplifier circuit 1006 between the analog signal input and the digital signal input. It should be noted that the second amplifier circuit 1006 is one of the correction circuits for adjusting the level of audio signals.

Specifically, when a gain of the first amplifier circuit is set at five times, the first amplifier circuit can output a voltage at 1.4 Vpp. When a gain of the second amplifier circuit 1006 is set at 7.09 times in the case of an analog signal input and 1.25 times in the case of a digital signal input, the speaker connecting portion 1008 can output a voltage at 10 Vpp in either case. It should be noted that the gain as described above is only an example. Therefore, the invention is not limited to this and it can be set appropriately.

As described above, in this embodiment mode, a glitch level relatively to an audio signal can be suppressed by using the common power supply voltage for the D/A converter circuit and the signal line driver circuit, thus S/N ratio of the output of the D/A converter circuit can be improved. In addition, by amplifying only an analog signal in the first amplifier circuit and changing the gain of the second amplifier circuit between an analog signal input and a digital signal input, each of the signals can be set equal in levels in either case of the analog signal input or the digital signal input.

Accordingly, high-quality audio data can be supplied to users.

Embodiment 6

Figure 11:
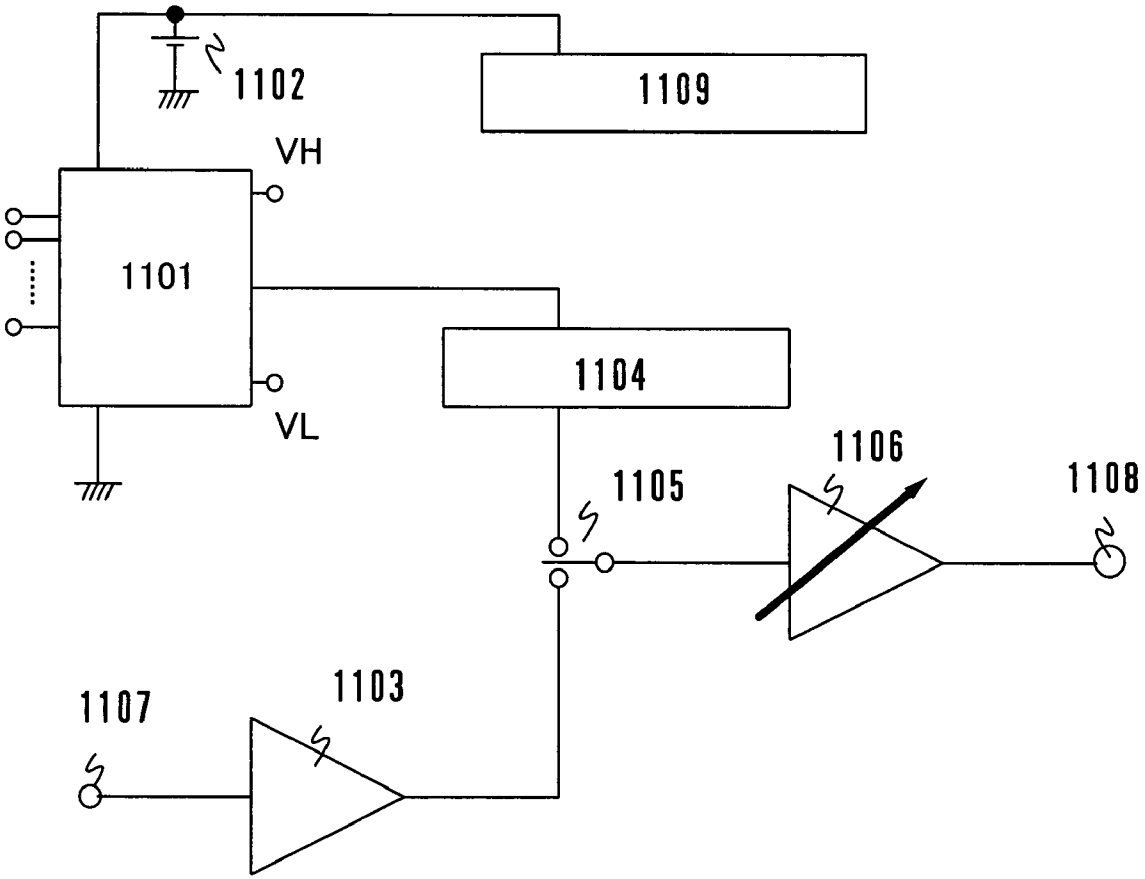
FIG. 11 illustrates an embodiment of an audio signal processing circuit of the liquid crystal display device of the invention.

FIG. 11 is a diagram showing Embodiment 6 of the invention. As shown in FIG. 11, the circuit of this embodiment includes a D/A converter circuit 1101, a power supply 1102 for the D/A converter circuit 1101, a first amplifier circuit 1103, an attenuator circuit 1104, a second amplifier circuit 1106, an analog audio signal input terminal 1107, a D/A selection switch 1105, a speaker connecting portion 1108 and a signal line driver circuit 1109. Description is given below on the assumption that the signal level of the analog audio signal input terminal 1107 is at 283 mVpp while the signal level of the speaker connecting portion 1108 is at 10 Vpp as in the conventional circuit.

In this embodiment, the D/A converter circuit 1101 is connected to the same power supply voltage as the signal line driver circuit 1109 to obtain a high level voltage. For example, when the power supply 1002 for the D/A converter circuit 1101 is set at 16 V, the D/A converter circuit 1101 can obtain an output voltage having an amplitude of 5 V or more. That is, when the VH is at 12 V while the VL is at 4 V, the D/A converter circuit 1102 can obtain an output voltage having an amplitude of 8 Vpp at largest, which means the S/N ratio can be suppressed to 1/800 even when a glitch of about 10 mV is generated as in the conventional D/A converter circuit.

On the other hand, since an analog audio signal input to the analog audio signal input terminal 1107 is at 283 mVpp as in the conventional circuit, a gain in the case of a digital signal input has to be lowered down to 0.0353 times so that each of the signal levels can be equal to each other between an analog signal input and an digital signal input. In this embodiment, only an analog audio signal passes through the first amplifier circuit 1103, the output signal of the D/A converter circuit 1101 is attenuated in the attenuator circuit 1104 and the gain of the second amplifier circuit 1106 is changed between analog signal input and digital signal input in order that each of the signals is adjusted to be equal in levels at the speaker connecting portion 1108.

Specifically, when the gain of the first amplifier circuit 1103 is set at five times, the first amplifier circuit 1103 can output a voltage at 1.41 Vpp. When the attenuation ratio of the attenuator circuit 1104 is set at 0.2 times while the gain of the second amplifier circuit 1106 is set at five times in the case of a digital signal input, the speaker connecting portion 1108 can output a voltage at 10 Vpp. In addition, when the gain of the second amplifier circuit 1106 is set at 7.09 times in the case of an analog signal input, the speaker connecting portion 1108 can output a voltage at 10 Vpp. In this manner, each of the signals can be adjusted to be equal in levels between the digital signal input and the analog signal input. It should be noted that the gain as described above is only an example. Therefore, the invention is not limited to this and it can be set appropriately.

As described above, in this embodiment mode, a glitch level relatively to an audio signal can be suppressed by using the common power supply voltage for the D/A converter circuit and the signal line driver circuit, thus the S/N ratio of the output of the D/A converter circuit can be improved. In addition, by amplifying only an analog signal in the first amplifier circuit, attenuating the output signal of the D/A converter circuit in the attenuator circuit and changing the gain of the second amplifier circuit between an analog signal input and a digital signal input, each of the signals can be adjusted to be equal in levels at the speaker connecting portion 1108 in either case. It should be noted that each of the attenuator circuit and the amplifier circuits is one of the correction circuits for adjusting the level of audio signals.

Accordingly, high-quality audio data can be supplied to users.

Embodiment 7

Figure 14:
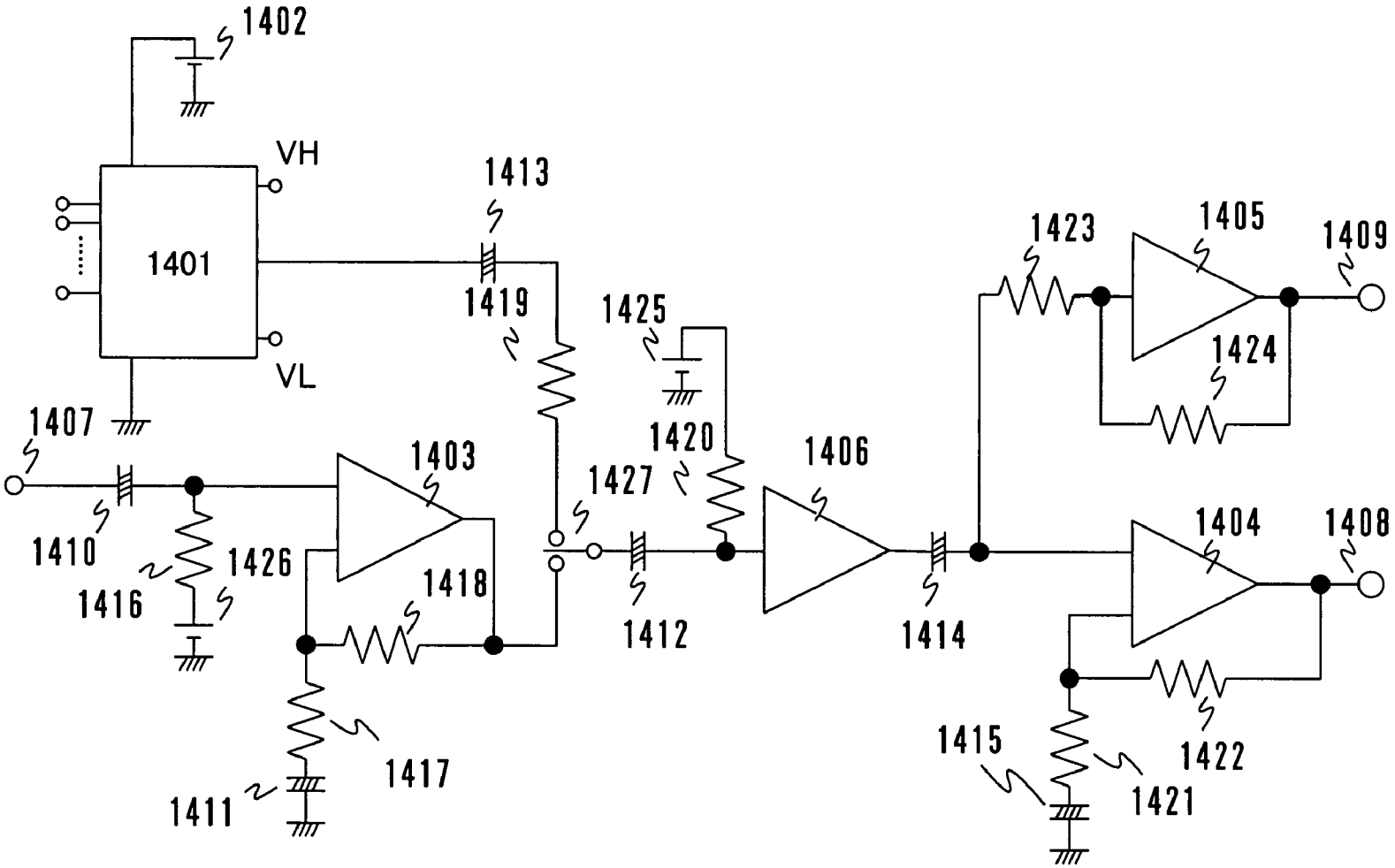
FIG. 14 illustrates a circuit diagram of an audio signal processing circuit of the liquid crystal display device of the invention.

FIG. 14 is a diagram showing Embodiment 7 of the invention. As shown in FIG. 14, the circuit of this embodiment includes a D/A converter circuit 1401, a power supply 1402 for the D/A converter circuit 1401, a first amplifier circuit 1403, a second amplifier circuit 1404, a third amplifier circuit 1405, a buffer amplifier circuit 1406, an analog audio signal input terminal 1407, speaker connecting portions 1408 and 1409, coupling capacitors 1410, 1412, 1413 and 1414, smoothing capacitors 1411 and 1415, input resistors 1416 and 1420, an attenuator resistor 1419, gain-setting resistors 1417, 1418, 1421, 1422, 1423 and 1424, an D/A selection switch 1427 and bias power supplies 1425 and 1426. Description is given below on the assumption that a signal of the analog audio signal input terminal 1407 is at a level of 283 mVpp while signals of the speaker connecting portions 1408 and 1409 are each at a level of 10 Vpp as in the conventional circuit.

The operation thereof is described now. In the case of a digital signal input, the output of the D/A converter circuit 1401 is input to the input resistor 1420 and the buffer amplifier circuit 1406 through the D/A selection switch 1427 and the coupling capacitor 1412. At this time, the signal is divided into the one for the attenuator resistor 1419 and the other for the input resistor 1420. Therefore, when the resistor 1419 has a resistance of 823 kO and the resistor 1420 has a resistance of 177 kO for example, the input signal of the buffer amplifier circuit 1406 is at a level of 1.41 Vpp. Since the gain of the buffer amplifier circuit 1406 is 1, the coupling capacitor 1414 is input with a signal of 1.41 Vpp. The output signal of the coupling capacitor 1414 is input to an inverting amplifier circuit including the resistors 1423 and 1424 and the amplifier circuit 1405 and to a non-inverting amplifier circuit including the resistors 1421 and 1422 and the amplifier circuit 1414. Assuming that each of the resistors 1423 and 1424 has a resistance of 100 kO and 709 kO respectively, a gain of the non-inverting amplifier circuit is 7.09 times. Meanwhile, assuming that each of the resistors 1421 and 1422 has a resistance of 100 kO and 609 kO respectively, a gain of the non-inverting amplifier circuit is 7.09 times as well, and the speaker connecting portions 1408 and 1409 can output a signal at a level of around 10 Vpp. Outputs of the speaker connecting portions 1408 and 1409 have opposite phase to each other, enabling a BLT drive. It should be noted that the description is heretofore made on the assumption that a BLT drive is employed for driving speakers, however, the invention is not limited to this and other driving methods can be employed as well.

In addition, in the case of an analog signal input, a signal at a level of 283 mVpp is input from the analog audio signal input terminal 1407, and then input to the resistor 1416 and the first amplifier circuit 1403 through the coupling capacitor 1410. A gain of the first amplifier circuit 1403 is determined by the gain-setting resistors 1417 and 118. When the gain-setting resistor 1417 has a resistance of 100 kO while the gain-setting resistor 1418 has a resistance of 400 kO, a gain of the first amplifier circuit 1403 is five times as large and the output voltage is at a level of 1.41 Vpp. The output of the first amplifier circuit 1403 is input to the third buffer amplifier circuit 1406 through the DA selection switch 1427 and the coupling capacitor 1412. The subsequent operation is the same as the case of digital signal input.

As described above, in this embodiment, a glitch level relatively to an audio signal can be suppressed by using the common power supply voltage for the D/A converter circuit and the signal line driver circuit, thus the S/N ratio of the output of the D/A converter circuit can be improved. In addition, by amplifying only an analog signal in the first amplifier circuit and attenuating the output signal of the D/A converter circuit in the attenuator circuit, each of the analog signal and the digital signal can be adjusted to be equal in levels at the speaker connecting portion.

Embodiment 8

Figure 15A:
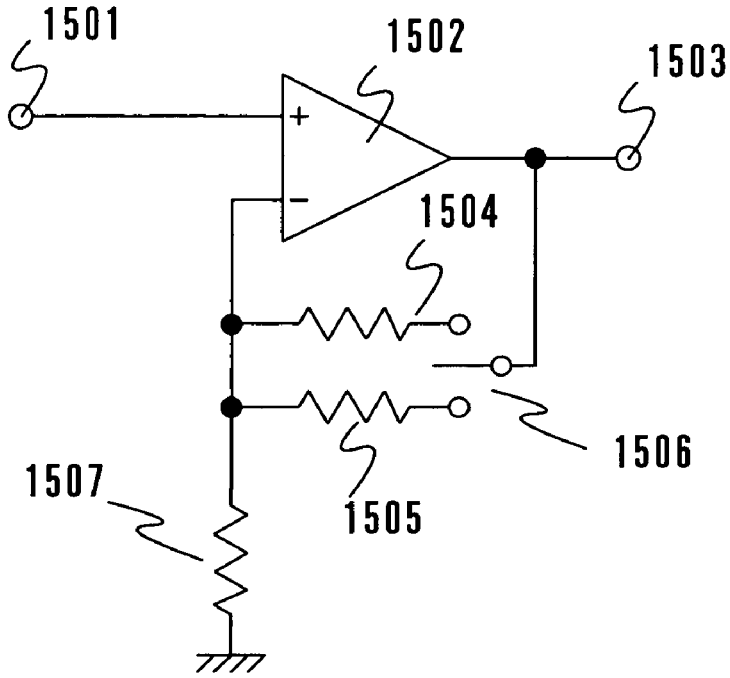
FIGS. 15A and 15B illustrate diagrams of variable gain means of the amplifier circuit of the invention.
Figure 15B:
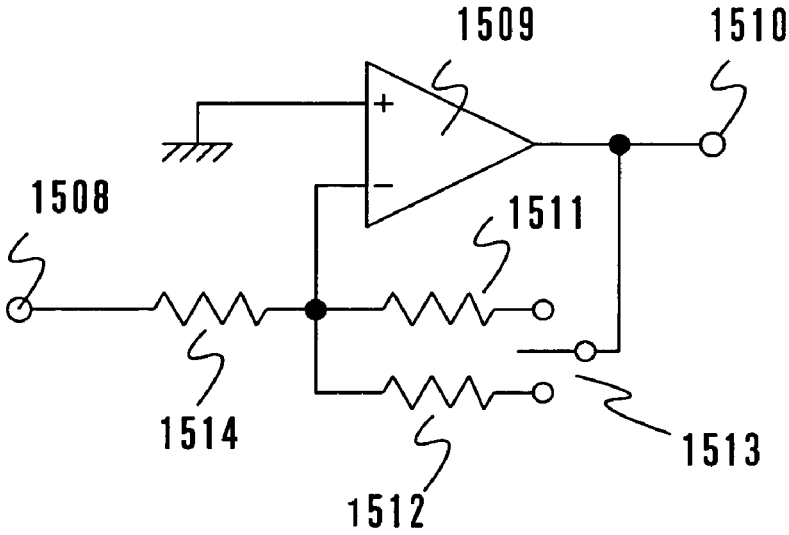

FIGS. 15A and 15B are diagrams showing Embodiment 8 of the invention. FIG. 15A is a non-inverting amplifier circuit which includes an input terminal 1501, an amplifier circuit 1502, an output terminal 1503, resistors 1504, 1505 and 1507 and a switch 1506. When the switch 1506 selects the resistor 1504, a gain of the amplifier circuit 1502 is equal to 1+(resistance value of the resistor 1504/resistance value of the resistor 1507). Meanwhile when the switch 1506 selects the resistor 1505, a gain of the amplifier circuit 1502 is equal to 1+(resistance value of the resistor 1505/resistance value of the resistor 1507). By changing over the switch 1506, a gain can be appropriately changed.

FIG. 15B is an inverting amplifier circuit which includes an input terminal 1508, an amplifier circuit 1509, an output terminal 1510, resistors 1511, 1512 and 1514 and a switch 1513. When the switch 1513 selects the resistor 1511, a gain of the amplifier circuit 1509 is equal to (resistance value of the resistor 1511/resistance value of the resistor 1514). Meanwhile when the switch 1513 selects the resistor 1512, a gain of the amplifier circuit 1509 is equal to (resistance value of the resistor 1512/resistance value of the resistor 1514). By changing over the switch 1513, a gain can be appropriately changed.

As described above, by constructing the amplifier circuit which enables a feedback resistor to be switched, a gain of the amplifier circuit can be changed. Thus, this embodiment can be freely implemented with any combination of Embodiments 4 to 6. It should be noted that the circuit for changing the gain is not limited to the one shown in this embodiment. Other circuit configurations can be employed as well.

Embodiment 9

Figure 13B:
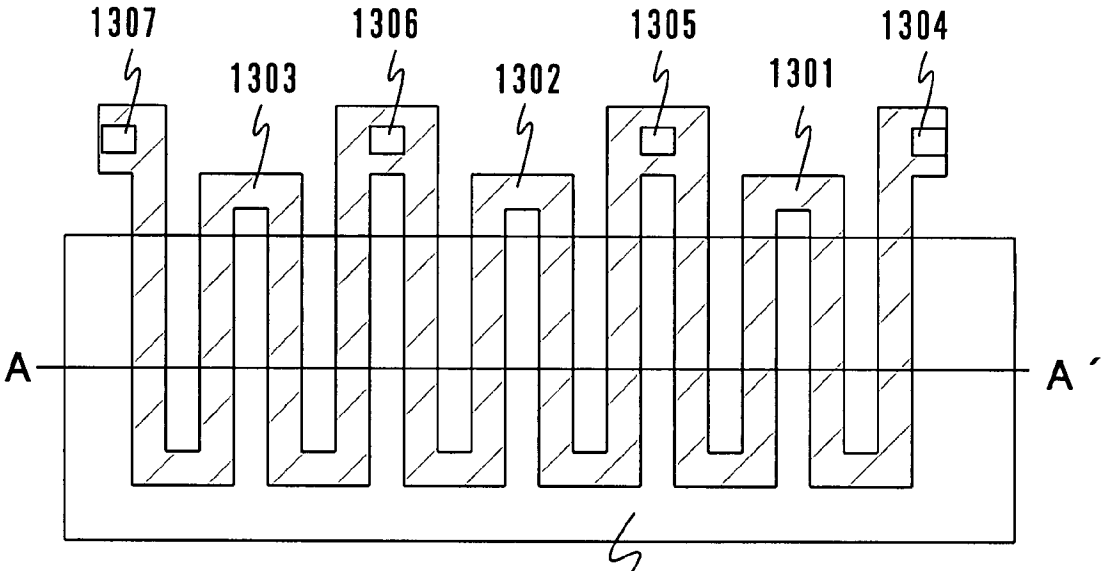
FIGS. 13A to 13C illustrate layouts of the D/A converter circuit of the invention.
Figure 13C:
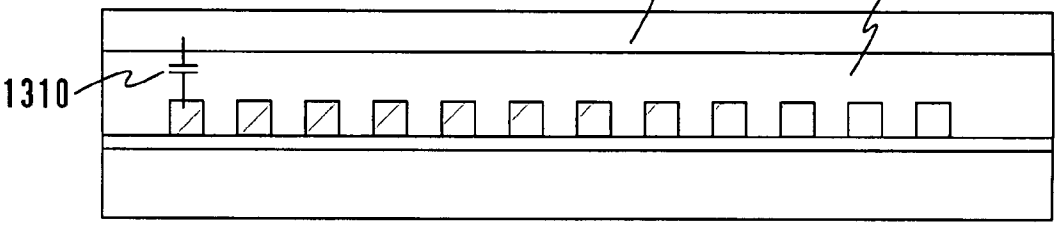
Figure 13A:
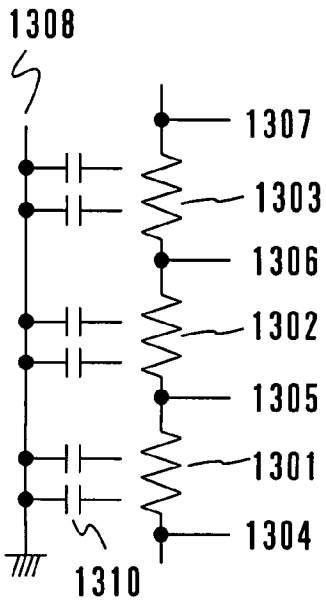

FIGS. 13A to 13C are diagrams showing Embodiment 9 of the invention. FIG. 13A is a cross sectional view showing a construction of the resistor string D/A converter circuit of the invention. The resistor string shown in FIG. 13B includes resistors 1301 to 1303 each formed of a conductive film and disposed in a serpentine manner and contact holes 1304 to 1307 at each connecting node. As for the conductive thin film, a silicon island-like semiconductor film doped with impurities, a metal thin film used for a gate electrode material and a wiring or the like is used. In this embodiment, a conductive layer is formed over each of the resistors through an insulating film 1309. Specifically, the conductive layer 1308 corresponds to a source and a drain of a TFT, and is covered over each resistor with a capacitor 1301 interposed therebetween. FIG. 13C is a cross sectional view thereof. The equivalent circuit diagram thereof corresponds to FIG. 13A. By disposing the capacitor in such a manner, a potential of the D/A converter circuit is stabilized, and a glitch can thus be reduced. Accordingly, high-quality audio data can be supplied to users. This embodiment can be freely implemented with any combination of Embodiment Modes 1 to 6 or Embodiments 1 to 6.

Embodiment 10

Figure 16:
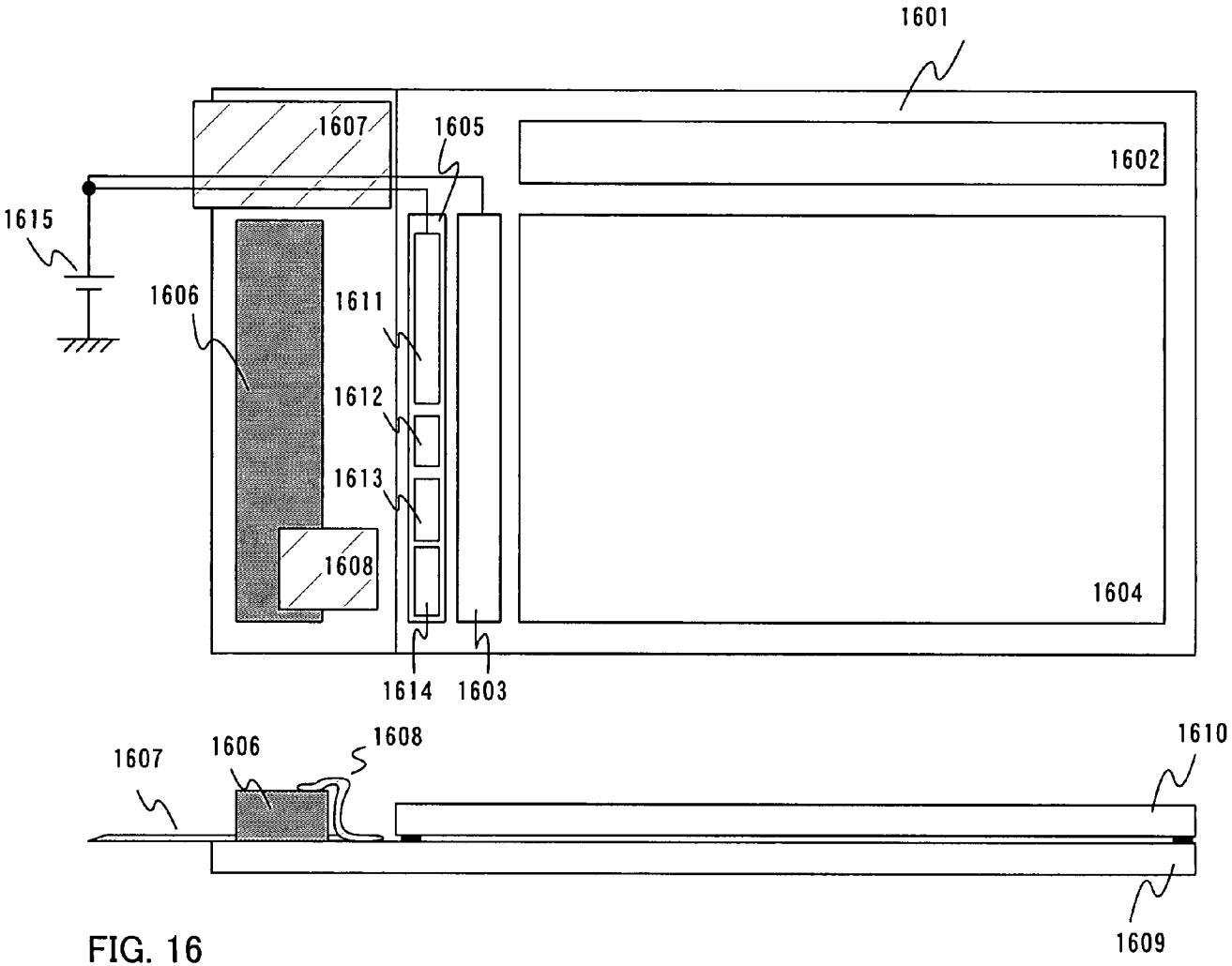
FIG. 16 illustrates a top plan view and a side elevational view of the liquid crystal display device of the invention.

FIG. 16 is a diagram showing Embodiment 10 of the invention. FIG. 16 is an embodiment of a liquid crystal display device 1601 using the invention. The liquid crystal display device 1601 includes a TFT substrate 1609 which is mounted with a source signal line driver circuit 1602, a gate signal line driver circuit 1603, a pixel portion 1604 and an audio signal processing circuit 1605 each using thin film elements. Furthermore, a speaker 1606 using piezoelectric elements and FPCs 1607 and 1608 are also mounted on the TFT substrate 1609. In addition, liquid crystal is sandwiched between a counter substrate 1610 and the TFT substrate 1609 as shown in FIG. 16B. The audio signal processing circuit 1605 integrated on the TFT substrate 1609 includes a D/A converter circuit 1611, a first amplifier circuit 1612, a switch 1613 and a second amplifier circuit 1614. However, the invention is not limited to this. In addition, the speaker 1606 is not limited to the one using piezoelectric elements, and other types of speaker can be employed as well.

As described above, according to the invention, the D/A converter circuit 1611 can output a signal having a large amplitude by using the common power supply for the source signal line driver circuit 1602 or the gate signal line driver circuit 1603 and the D/A converter circuit 1611. Therefore, an S/N ratio in the case of a digital signal input can be improved and high-quality audio data can be thus obtained. In FIG. 16, the power supply 1615 supplies voltage to the D/A converter circuit 1611 and the gate signal line driver circuit 1603. Although they are connected around the power supply 1615 in FIG. 16, they may be connected on the substrate 1609. Thus, this embodiment can be freely implemented with any combination of Embodiment Modes 1 to 6 and Embodiments 1 to 9.

Embodiment 11

A display device manufactured in accordance with the foregoing Embodiment Modes and Embodiments can be used in a display portion of a variety of electronic apparatuses. Described below are electronic apparatuses each using the display device of the invention as a display medium.

Example of the electronic apparatuses include a video camera, a digital camera, a head mounted display (goggle type display), a game player, a car navigation system, a personal computer, a mobile information terminal (such as a mobile computer, a mobile phone, an electronic book or the like). Examples of these electronic apparatuses are described below.

Figure 12A:
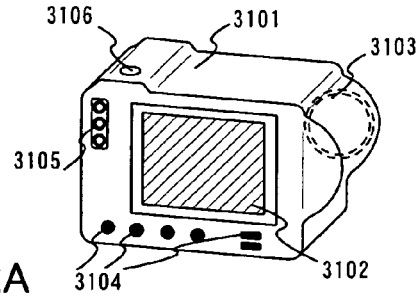
FIGS. 12A to 12G illustrate views of electronic apparatuses using the liquid crystal display device of the invention.

FIG. 12A is a digital camera which includes a main body 3101, a display portion 3102, an image receiving portion 3103, operating switches 3104, an external connecting port 3105, a shutter 3106 or the like. By using the display device of the invention in the display portion 3102, a compact and lightweight digital camera can be provided.

Figure 12B:
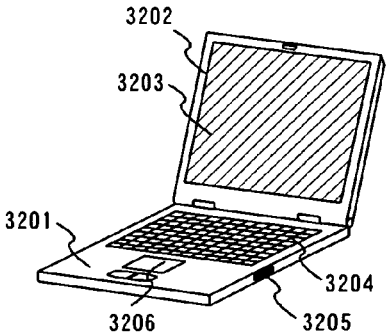

FIG. 12B is a notebook personal computer which includes a main body 3201, a housing 3202, a display portion 3203, a keyboard 3204, an external connecting port 3205, a pointing mouse 3206 or the like. By using the display device of the invention in the display portion 3203, a compact and lightweight digital camera can be provided.

Figure 12C:
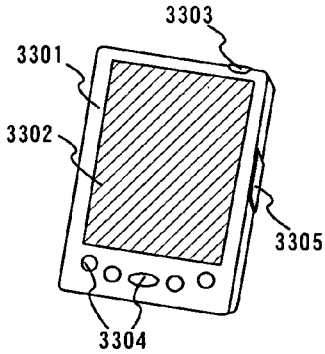

FIG. 12C is a mobile information terminal which includes a main body 3303, a display portion 3302, a switch 3303, operating keys 3304, an IR port 3305 or the like. By using the display device of the invention in the display portion 3302, a compact and lightweight mobile information terminal can be provided.

Figure 12D:
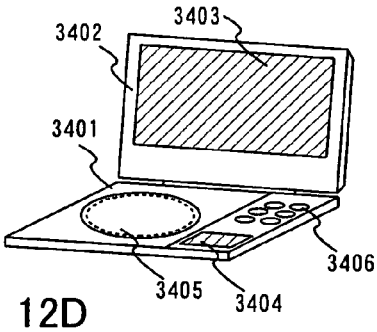

FIG. 12D is an image reproducing display device (specifically, a DVD playback device) which includes a main body 3401, a housing 3402, a recording medium (such as CD, LD or DVD) reading portion 3405, an operating switch 3406, a display portion A3403, a display portion B3404 or the like. The display portion A3403 mainly displays image data while the display portion B3404 displays mainly text data. The display device of the invention can be used in the display portion A3403 and the display portion B3404 of the image reproducing device provided with a recording medium. It should be noted that the image reproducing device provided with a recording medium includes a CD playback device, a game player or the like. By using the display device of the invention in the display portion thereof, a compact and lightweight image reproducing device can be provided.

Figure 12E:
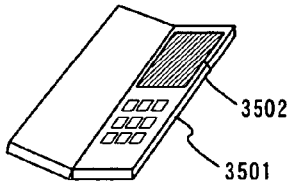

FIG. 12E is a folding mobile display device which includes a main body 3501 and a display portion 3502. By using the display device of the invention in the display portion 3502, a compact and lightweight mobile display device can be provided.

Figure 12F:
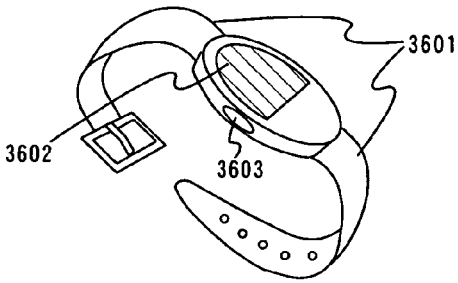

FIG. 12F is a watch type communicator which includes a main body 3601 mounted with a display portion 3602, an operating key 3603 or the like. By using the display device of the invention in the display portion 3602, a compact and lightweight watch type communicator can be provided.

Figure 12G:
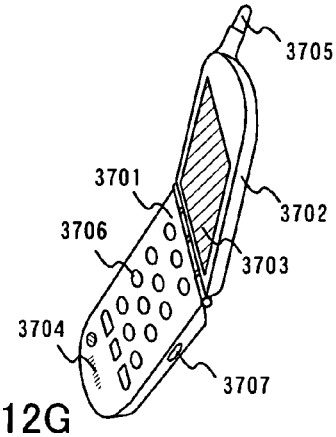

FIG. 12G is a mobile phone which includes a main body 3701, a housing 3702, a display portion 3703, an audio input portion 3704, an antenna 3705, an operating key 3706, an external connecting port 3707 or the like. By using the display device of the invention in the display portion 3702, a compact and lightweight mobile phone can be provided.

As described above, the applicable range of the invention is so wide that the invention can be applied to electronic apparatuses of various fields. In addition, the electronic apparatuses of this embodiment can be implemented with any combination of Embodiment Modes 1 to 6 and Embodiments 1 to 10.

This application is based on Japanese Patent Application serial no. 2003-285984 filed in Japan Patent Office on 4th, Aug., 2003, the contents of which are hereby incorporated by reference. Although the invention has been fully described by way of Embodiment Modes and Embodiments with reference to the accompanying drawings, it is to be understood that various changes and modifications will be apparent to those skilled in the art. Therefore, unless such changes and modifications depart from the scope of the invention hereinafter defined, they should be constructed as being included therein.

What is claimed is:

1. A liquid crystal display device comprising:

an insulating surface;

a pixel over the insulating surface;

a source signal line electrically connected to the pixel, over the insulating surface;

a gate signal line electrically connected to the pixel, over the insulating surface;

a signal line driver circuit configured to drive at least one of the gate signal line and the source signal line;

a D/A converter circuit configured to convert a digital audio signal into a first analog audio signal;

a power supply circuit configured to supply a same voltage to the signal line driver circuit and the D/A converter circuit;

a level correction circuit, wherein the level correction circuit is an attenuator circuit configured to attenuate the first analog audio signal; and a switch configured to select a selected signal from a plurality of analog signals comprising the attenuated first analog audio signal and a second analog audio signal inputted externally.

2. A liquid crystal display device according to claim 1, wherein the signal line driver circuit and the D/A converter circuit are formed over the insulating substrate.

3. A liquid crystal display device according to claim 1, wherein the signal line driver circuit comprises a thin film transistor.

4. A liquid crystal display device according to claim 1, wherein the D/A converter circuit comprises a thin film transistor.

5. A liquid crystal display device according to claim 1, wherein the D/A converter circuit is a resistor string type D/A converter circuit.

6. A liquid crystal display device according to claim 5, wherein a resistor included in the resistor string type D/A converter circuit comprises a thin film semiconductor.

7. A liquid crystal display device according to claim 6, wherein the thin film semiconductor forms a capacitance with a conductive layer adjacent to the thin film semiconductor.

8. A liquid crystal display device according to claim 5, wherein a resistor included in the resistor string type D/A converter circuit comprises a metal thin film.

9. A liquid crystal display device according to claim 8, wherein the metal film thin film forms a capacitance with a conductive layer adjacent to the metal thin film.

10. An electronic apparatus including the liquid crystal display device according to claim 1, wherein the electronic apparatus is one selected from the group consisting of a video camera, a digital camera, a head mounted display, a game player, a car navigation system, a personal computer, a mobile information terminal, a mobile computer, a mobile phone, and an electronic book.

11. A liquid crystal display device comprising:

an insulating surface;

a pixel over the insulating surface;

a source signal line electrically connected to the pixel, over the insulating surface;

a gate signal line electrically connected to the pixel, over the insulating surface;

a signal line driver circuit configured to drive at least one of the gate signal line and the source signal line;

a D/A converter circuit configured to convert a digital audio signal into a first analog audio signal;

a power supply circuit configured to supply a same voltage to the signal line driver circuit and the D/A converter circuit;

a level correction circuit, wherein the level correction circuit is an attenuator circuit configured to attenuate the first analog audio signal;

an amplifier circuit configured to amplify a second analog audio signal inputted externally; and a switch configured to select a selected signal from a plurality of analog signals comprising the attenuated first analog audio signal and the amplified second analog audio signal.

12. A liquid crystal display device according to claim 11, wherein the signal line driver circuit and the D/A converter circuit are formed over the insulating substrate.

13. A liquid crystal display device according to claim 11, wherein the signal line driver circuit comprises a thin film transistor.

14. A liquid crystal display device according to claim 11, wherein the D/A converter circuit comprises a thin film transistor.

15. A liquid crystal display device according to claim 11, wherein the D/A converter circuit is a resistor string type D/A converter circuit.

16. A liquid crystal display device according to claim 15, wherein a resistor included in the resistor string type D/A converter circuit comprises a thin film semiconductor.

17. A liquid crystal display device according to claim 16, wherein the thin film semiconductor forms a capacitance with a conductive layer adjacent to the thin film semiconductor.

18. A liquid crystal display device according to claim 15, wherein a resistor included in the resistor string type D/A converter circuit comprises a metal thin film.

19. A liquid crystal display device according to claim 18, wherein the metal film thin film forms a capacitance with a conductive layer adjacent to the metal thin film.

20. An electronic apparatus including the liquid crystal display device according to claim 11, wherein the electronic apparatus is one selected from the group consisting of a video camera, a digital camera, a head mounted display, a game player, a car navigation system, a personal computer, a mobile information terminal, a mobile computer, a mobile phone, and an electronic book.

21. A liquid crystal display device comprising:

an insulating surface;

a pixel over the insulating surface;

a source signal line electrically connected to the pixel, over the insulating surface;

a gate signal line electrically connected to the pixel, over the insulating surface;

a signal line driver circuit configured to drive at least one of the gate signal line and the source signal line;

a D/A converter circuit configured to convert a digital audio signal into a first analog audio signal;

a power supply circuit configured to supply a same voltage to the signal line driver circuit and the D/A converter circuit;

a level correction circuit, wherein the level correction circuit is an attenuator circuit configured to attenuate the first analog audio signal;

a switch configured to select a selected signal from a plurality of analog signals comprising the attenuated first analog audio signal and a second analog audio signal inputted externally; and an amplifier circuit amplifying the selected signal.

22. A liquid crystal display device according to claim 21, wherein the signal line driver circuit and the D/A converter circuit are formed over the insulating substrate.

23. A liquid crystal display device according to claim 21, wherein the signal line driver circuit comprises a thin film transistor.

24. A liquid crystal display device according to claim 21, wherein the D/A converter circuit comprises a thin film transistor.

25. A liquid crystal display device according to claim 21, wherein the D/A converter circuit is a resistor string type D/A converter circuit.

26. A liquid crystal display device according to claim 25, wherein a resistor included in the resistor string type D/A converter circuit comprises a thin film semiconductor.

27. A liquid crystal display device according to claim 26, wherein the thin film semiconductor forms a capacitance with a conductive layer adjacent to the thin film semiconductor.

28. A liquid crystal display device according to claim 25, wherein a resistor included in the resistor string type D/A converter circuit comprises a metal thin film.

29. A liquid crystal display device according to claim 28, wherein the metal film thin film forms a capacitance with a conductive layer adjacent to the metal thin film.

30. An electronic apparatus including the liquid crystal display device according to claim 21, wherein the electronic apparatus is one selected from the group consisting of a video camera, a digital camera, a head mounted display, a game player, a car navigation system, a personal computer, a mobile information terminal, a mobile computer, a mobile phone, and an electronic book.

31. A liquid crystal display device comprising:

an insulating surface;

a pixel over the insulating surface;

a source signal line electrically connected to the pixel, over the insulating surface;

a gate signal line electrically connected to the pixel, over the insulating surface;

a signal line driver circuit configured to drive at least one of the gate signal line and the source signal line;

a D/A converter circuit configured to convert a digital audio signal into a first analog audio signal;

a power supply circuit configured to supply a same voltage to the signal line driver circuit and the D/A converter circuit;

a level correction circuit, wherein the level correction circuit is an attenuator circuit configured to attenuate the first analog audio signal;

a first amplifier circuit configured to amplify a second analog audio signal inputted externally;

a switch configured to select a selected signal from a plurality of analog signals comprising the attenuated first analog audio signal and the amplified second analog audio signal; and a second amplifier circuit amplifying the selected signal.

32. A liquid crystal display device according to claim 31, wherein the signal line driver circuit and the D/A converter circuit are formed over the insulating substrate.

33. A liquid crystal display device according to claim 31, wherein the signal line driver circuit comprises a thin film transistor.

34. A liquid crystal display device according to claim 31, wherein the D/A converter circuit comprises a thin film transistor.

35. A liquid crystal display device according to claim 31, wherein the D/A converter circuit is a resistor string type D/A converter circuit.

36. A liquid crystal display device according to claim 35, wherein a resistor included in the resistor string type D/A converter circuit comprises a thin film semiconductor.

37. A liquid crystal display device according to claim 36, wherein the thin film semiconductor forms a capacitance with a conductive layer adjacent to the thin film semiconductor.

38. A liquid crystal display device according to claim 35, wherein a resistor included in the resistor string type D/A converter circuit comprises a metal thin film.

39. A liquid crystal display device according to claim 38, wherein the metal film thin film forms a capacitance with a conductive layer adjacent to the metal thin film.

40. An electronic apparatus including the liquid crystal display device according to claim 31, wherein the electronic apparatus is one selected from the group consisting of a video camera, a digital camera, a head mounted display, a game player, a car navigation system, a personal computer, a mobile information terminal, a mobile computer, a mobile phone, and an electronic book.

41. A liquid crystal display device comprising:

an insulating surface;

a pixel over the insulating surface;

a source signal line electrically connected to the pixel, over the insulating surface;

a gate signal line electrically connected to the pixel, over the insulating surface;

a signal line driver circuit configured to drive at least one of the gate signal line and the source signal line;

a D/A converter circuit configured to convert a digital audio signal into a first analog audio signal;

a power supply circuit configured to supply a same voltage to the signal line driver circuit and the D/A converter circuit;

a level correction circuit, wherein the level correction circuit is an attenuator circuit configured to attenuate the first analog audio signal;

a switch configured to select a selected signal from a plurality of analog signals comprising the attenuated first analog audio signal and a second analog audio signal inputted externally;

an amplifier circuit amplifying the selected signal; and wherein a gain of the amplifier circuit is changed according to the selection of the switch.

42. A liquid crystal display device according to claim 41, wherein the signal line driver circuit and the D/A converter circuit are formed over the insulating substrate.

43. A liquid crystal display device according to claim 41, wherein the signal line driver circuit comprises a thin film transistor.

44. A liquid crystal display device according to claim 41, wherein the D/A converter circuit comprises a thin film transistor.

45. A liquid crystal display device according to claim 41, wherein the D/A converter circuit is a resistor string type D/A converter circuit.

46. A liquid crystal display device according to claim 45, wherein a resistor included in the resistor string type D/A converter circuit comprises a thin film semiconductor.

47. A liquid crystal display device according to claim 46, wherein the thin film semiconductor forms a capacitance with a conductive layer adjacent to the thin film semiconductor.

48. A liquid crystal display device according to claim 45, wherein a resistor included in the resistor string type D/A converter circuit comprises a metal thin film.

49. A liquid crystal display device according to claim 48, wherein the metal film thin film forms a capacitance with a conductive layer adjacent to the metal thin film.

50. A liquid crystal display device according to claim 41, wherein the amplifier circuit is an operational amplifier and a gain is changed by switching a feedback register.

51. An electronic apparatus including the liquid crystal display device according to claim 41, wherein the electronic apparatus is one selected from the group consisting of a video camera, a digital camera, a head mounted display, a game player, a car navigation system, a personal computer, a mobile information terminal, a mobile computer, a mobile phone, and an electronic book.

52. A liquid crystal display device comprising:

an insulating surface;

a pixel over the insulating surface;

a source signal line electrically connected to the pixel, over the insulating surface;

a gate signal line electrically connected to the pixel, over the insulating surface;

a signal line driver circuit configured to drive at least one of the gate signal line and the source signal line;

a D/A converter circuit configured to convert a digital audio signal into a first analog audio signal;

a power supply circuit configured to supply a same voltage to the signal line driver circuit and the D/A converter circuit;

a level correction circuit, wherein the level correction circuit is an attenuator circuit configured to attenuate the first analog audio signal;

a first amplifier circuit configured to amplify a second analog audio signal inputted externally;

a switch configured to select a selected signal from a plurality of analog signals comprising the attenuated first analog audio signal and the amplified second analog audio signal;

a second amplifier circuit amplifying the selected signal; and wherein a gain of the second amplifier circuit is changed according to the selection of the switch.

53. A liquid crystal display device according to claim 52, wherein the signal line driver circuit and the D/A converter circuit are formed over the insulating substrate.

54. A liquid crystal display device according to claim 52, wherein the signal line driver circuit comprises a thin film transistor.

55. A liquid crystal display device according to claim 52, wherein the D/A converter circuit comprises a thin film transistor.

56. A liquid crystal display device according to claim 52, wherein the D/A converter circuit is a resistor string type D/A converter circuit.

57. A liquid crystal display device according to claim 56, wherein a resistor included in the resistor string type D/A converter circuit comprises a thin film semiconductor.

58. A liquid crystal display device according to claim 57, wherein the thin film semiconductor forms a capacitance with a conductive layer adjacent to the thin film semiconductor.

59. A liquid crystal display device according to claim 56, wherein a resistor included in the resistor string type D/A converter circuit comprises a metal thin film.

60. A liquid crystal display device according to claim 59, wherein the metal film thin film forms a capacitance with a conductive layer adjacent to the metal thin film.

61. A liquid crystal display device according to claim 52, wherein the second amplifier circuit is an operational amplifier and a gain is changed by switching a feedback register.

62. An electronic apparatus including the liquid crystal display device according to claim 52, wherein the electronic apparatus is one selected from the group consisting of a video camera, a digital camera, a head mounted display, a game player, a car navigation system, a personal computer, a mobile information terminal, a mobile computer, a mobile phone, and an electronic book.

63. A liquid crystal display device comprising:

an insulating surface;

a pixel over the insulating surface;

a source signal line electrically connected to the pixel, over the insulating surface;

a gate signal line electrically connected to the pixel, over the insulating surface;

a signal line driver circuit configured to drive at least one of the gate signal line and the source signal line;

a D/A converter circuit configured to convert a digital audio signal into a first analog audio signal;

a power supply circuit configured to supply a same voltage to the signal line driver circuit and the D/A converter circuit;

a level correction circuit configured to correct levels of a plurality of analog signals comprising the first analog audio signal;

an analog audio signal input terminal to input a second analog audio signal; and a switch circuit configured to select either of the first analog audio signal or the second analog audio signal.

64. A liquid crystal display device according to claim 63, wherein the signal line driver circuit and the D/A converter circuit are formed over the insulating substrate.

65. A liquid crystal display device according to claim 63, wherein the signal line driver circuit comprises a thin film transistor.

66. A liquid crystal display device according to claim 63, wherein the D/A converter circuit comprises a thin film transistor.

67. A liquid crystal display device according to claim 63, wherein the D/A converter circuit is a resistor string type D/A converter circuit.

68. A liquid crystal display device according to claim 67, wherein a resistor included in the resistor string type D/A converter circuit comprises a thin film semiconductor.

69. A liquid crystal display device according to claim 68, wherein the thin film semiconductor forms a capacitance with a conductive layer adjacent to the thin film semiconductor.

70. A liquid crystal display device according to claim 67, wherein a resistor included in the resistor string type D/A converter circuit comprises a metal thin film.

71. A liquid crystal display device according to claim 70, wherein the metal film thin film forms a capacitance with a conductive layer adjacent to the metal thin film.

72. An electronic apparatus including the liquid crystal display device according to claim 63, wherein the electronic apparatus is one selected from the group consisting of a video camera, a digital camera, a head mounted display, a game player, a car navigation system, a personal computer, a mobile information terminal, a mobile computer, a mobile phone, and an electronic book.

* * * * *